US007857683B2

(12) United States Patent
Burns et al.

(10) Patent No.: US 7,857,683 B2
(45) Date of Patent: Dec. 28, 2010

(54) CMP RETAINING RING

(75) Inventors: John Burns, Colorado Springs, CO (US); Martin L. Forbes, Divide, CO (US); Matthew A. Fuller, Colorado Springs, CO (US); Jeffery J. King, Colorado Springs, CO (US); Mark V. Smith, Colorado Springs, CO (US)

(73) Assignee: Entegris, Inc., Billerica, MA (US)

( * ) Notice: Subject to any disclaimer, the term of this patent is extended or adjusted under 35 U.S.C. 154(b) by 0 days.

(21) Appl. No.: 12/568,497

(22) Filed: Sep. 28, 2009

(65) Prior Publication Data

US 2010/0041323 A1 Feb. 18, 2010

Related U.S. Application Data

(63) Continuation of application No. 11/440,461, filed on May 24, 2006, now abandoned.

(60) Provisional application No. 60/684,151, filed on May 24, 2005, provisional application No. 60/765,995, filed on Feb. 6, 2006.

(51) Int. Cl.
*B24B 29/00* (2006.01)

(52) U.S. Cl. ..... 451/286; 451/287; 451/398

(58) Field of Classification Search ..... 451/41, 451/285, 286, 287, 288, 397, 398
See application file for complete search history.

(56) References Cited

U.S. PATENT DOCUMENTS 6,068,548 A 5/2000 Vote et al.
6,390,904 B1 5/2002 Gleason et al.
6,428,729 B1 8/2002 Bhatt et al.
6,835,125 B1 12/2004 Tseng et al.
6,893,327 B2 5/2005 Kajiwara et al.
6,899,610 B2 5/2005 Cooper et al.
6,974,371 B2 12/2005 Chen et al.
7,029,386 B2 4/2006 Young
7,118,456 B2 10/2006 Moloney et al.
7,086,939 B2 11/2006 Wilkinson et al.
7,134,948 B2 11/2006 Tseng et al.
7,485,028 B2 2/2009 Wilkinson et al.
2004/0219870 A1 11/2004 Chen et al.
2005/0005416 A1 1/2005 Sather et al.

OTHER PUBLICATIONS

Related U.S. Appl. No. 11/440,461, filed May 24, 2006 (bibliographic data and image file wrapper print outs).

*Primary Examiner*—Eileen P. Morgan
(74) *Attorney, Agent, or Firm*—Patterson Thuente Christensen Pedersen, P.A.

(57) ABSTRACT

An improved chemical mechanical polishing retaining ring. A representative embodiment comprises a base portion made from a wear-resistant plastic material, and an upper portion, or backbone portion, made from a stiffer and more wear resistant material. One of the base or backbone portion is preferably overmolded onto the other. The base portion can be generally defined by a flat pad-contacting surface, an outer surface, and an inner surface. The base portion can additionally include channels extending from the outer surface to the inner surface to facilitate transfer of slurry to and from the substrate to be polished during the process. One or both of the base portion or backbone portion further includes a plurality of circular ribs that serve to create additional bonding surface with the overmolded material. The retaining ring may additionally includes a plurality of bosses with threaded insert holes by which the retaining ring is attached to a chemical mechanical polishing system.

20 Claims, 25 Drawing Sheets

500

| Sample | Pull Out Force (lb) | Torque (in-lb) |
|---|---|---|
| 1 | 100+ | |
| 2 | 100+ | |
| 3 | 100+ | |
| 4 | 100+ | |
| 5 | | 15.00 |
| 6 | | 16.00 |
| 7 | | 16.00 |

FIG. 22

CMP RETAINING RING

PRIORITY APPLICATION

This application is a continuation of U.S. patent application Ser. No. 11/440,461, filed May 24, 2006, the disclosure of which is hereby incorporated by reference in its entirety, which claims priority to U.S. Provisional Patent Application No. 60/684,151, filed May 24, 2005, of the same title, the disclosure of which is hereby incorporated by reference in its entirety, and U.S. Provisional Patent Application No. 60/765,995, filed Feb. 6, 2006, of the same title, the disclosure of which is hereby incorporated by reference in its entirety.

FIELD OF THE INVENTION

The present invention relates to a retaining ring for holding semiconductor wafers in a chemical mechanical polishing apparatus.

BACKGROUND OF THE INVENTION

Integrated circuits can be formed on semiconductor substrates, particularly silicon wafers, by the sequential deposition of conductive, semiconductive and insulative layers on the wafer. Circuitry features can be etched on after each layer is deposited. After a series of layers have been deposited and etched, the uppermost surface of the substrate can become increasingly non-planar. Non-planar surfaces can cause problems in the photolithographic steps of the integrated circuit fabrication process. As such, it is necessary to periodically planarize the semiconductor substrate surface.

Damascene is a process in which interconnecting metal lines are formed by isolating dielectrics. In damascening, an interconnecting pattern is first lithographically defined in the layer of dielectric, and then metal is deposited to fill in the resulting trenches. Excess metal can be removed by chemical-mechanical polishing (planarization). Chemical-mechanical polishing (CMP), also called chemical-mechanical planarization, refers to a method of removing layers of solid through chemical-mechanical polishing carried out for the purpose of surface planarization and definition of the metal interconnecting pattern. Dual damascene is a modified version of the damascene process that is used to form metal interconnecting geometry using a CMP process instead of metal etching. In dual damascene, two interlayer dielectric patterning steps and one CMP step create a pattern that would otherwise require two patterning steps and two metal CMP steps when using a conventional damascene process.

In a typical CMP operation, a rotating polishing pad, which receives a chemically reactive slurry, is used to polish the outermost surface of the substrate. The substrate is positioned over the polishing pad and is held in place by a retaining ring. Typically the substrate and retaining ring are mounted on a carrier or polishing head. A controlled force is exerted on the substrate by the carrier head to press the substrate against the polishing pad. The movement of the polishing pad across the surface of the substrate causes material to be chemically and mechanically removed from the face of the substrate.

The machinery used to perform CMP is highly sophisticated, with equipment costing millions of dollars. Nevertheless, there are some components of the equipment that require frequent replacement during the polishing operation that contribute significantly to the high costs of CMP. One of these components is the retaining ring, which serves to contain and position the wafer as it is being planarized. As such, it is important to minimize the cost and time to manufacture retaining rings, and to maximize the durability of such rings as well as the ease with which they can be replaced.

SUMMARY OF THE INVENTION

One embodiment of the invention is a chemical mechanical polishing retaining ring. The retaining ring can be comprised of a base portion made from a wear-resistant plastic material, such as polyetheretherketone (PEEK), and an upper portion, or backbone portion, made from a stiffer and more wear resistant material, such as a ceramic or a ceramic filled polymer. One of the base portion or backbone is preferably overmolded onto the other. The base portion can be generally defined by a flat pad-contacting surface, an outer surface, an inner surface, an upper rim, and a recessed portion. The base portion can additionally include channels extending from the outer surface to the inner surface to facilitate transfer of slurry to and from the substrate to be polished during the process. Recessed portion further includes a plurality of circular ribs that serve to create a bond with the overmolded material. The recessed portion may additionally includes a plurality of bosses with threaded insert holes by which the retaining ring is attached to a CMP system. The ring shaped backbone portion may comprise one or more mounting fixtures, an inner edge, an outer edge, and a bonding surface that may include one or more ribs, channels, or a combination of these.

In some embodiments the stiffer polymer material for the backbone portion or upper portion, for example a ceramic filled polymer material, can be over-molded onto an unfilled polymer material for the base or lower portion. In other embodiments the unfilled polymer material for the base portion or lower portion can be overmolded onto the stiffer filled polymer material for the backbone portion or upper portion.

In a further embodiment of the CMP retaining ring, the base portion fully surrounds the backbone portion, such that the backbone portion is fully encapsulated within the base portion. The base portion can be generally defined by a flat pad-contacting surface, an outer surface, an inner surface, and an upper rim. The base portion can additionally include channels extending from the outer surface to the inner surface to facilitate transfer of slurry to and from the substrate to be polished during the process. The base portion further includes a plurality of circular ribs that serve to create a bond with the overmolded material. The retaining ring may additionally include a plurality of bosses with threaded insert holes by which the retaining ring is attached to a CMP system. The ring shaped backbone portion may comprise one or more mounting fixtures, an inner edge, an outer edge, and a bonding surface that may include one or more ribs, channels, or a combination of these, that serve to create a bond with the overmolded base portion material. In such an embodiment, the base portion is overmolded around the backbone portion such that the backbone portion is fully encapsulated within the base portion.

An advantage of an embodiment of the invention is flexural rigidity provided by the ceramic or ceramic-filled polymeric material that comprises the backbone portion of the retaining ring. This rigidity reduces or eliminates deformation caused by the attachment of the retaining ring and reduces the compressibility of the retaining ring. Deformation and compressibility of the ring can lead to an uneven distribution of force across the ring, which causes undesired changes in dimensions.

Another advantage of an embodiment of the present invention is the wear resistance and elasticity of the base portion of the retaining ring. Embodiments of the present invention provide a durable yet flexible material that prevents chipping or cracking of the substrate edge where it is supported by the ring while reducing wear on the ring where it contacts the polishing pad.

Another advantage of an embodiment of the present invention is increased bond strength between the overmolded base portion and backbone portions. The circular ribs created in the bonding portion of the base portion or backbone portion of the retaining ring allow for a solid bond to be created when the other portion is overmolded onto it. In embodiments utilizing injection molding, thinner ribs and walls can be created which provide increased bonding and strength.

Another advantage of an embodiment of the present invention is ease of application of the polishing slurry during the polishing process. The channels dispersed around the outside of the retaining ring base portion facilitate the transport of slurry to and from the substrate. The divergent openings to the channels on the inside and outside of the ring and between adjacent pads or foil shaped pads facilitates the transport of slurry to and from the substrate.

Another advantage of an embodiment of the present invention is decreased cost and maintenance. The retaining ring is durable and has to be replaced less often due to its rigid upper portion and wear resistant lower portion. The injection molding and overmolding processes used to create the retaining ring are also simple and inexpensive processes. In addition, by eliminating metal from all or a part of the retaining ring in embodiments of the invention, corrosion and metal particle contamination from abraded particles can be significantly reduced or eliminated when the retaining ring is exposed to acidic or other corrosive polishing chemistries.

BRIEF DESCRIPTION OF THE FIGURES

FIG. 22 is a table displaying pull-out testing results of a CMP retaining ring according to an embodiment of the present invention.

DETAILED DESCRIPTION OF THE INVENTION

Figure 1:
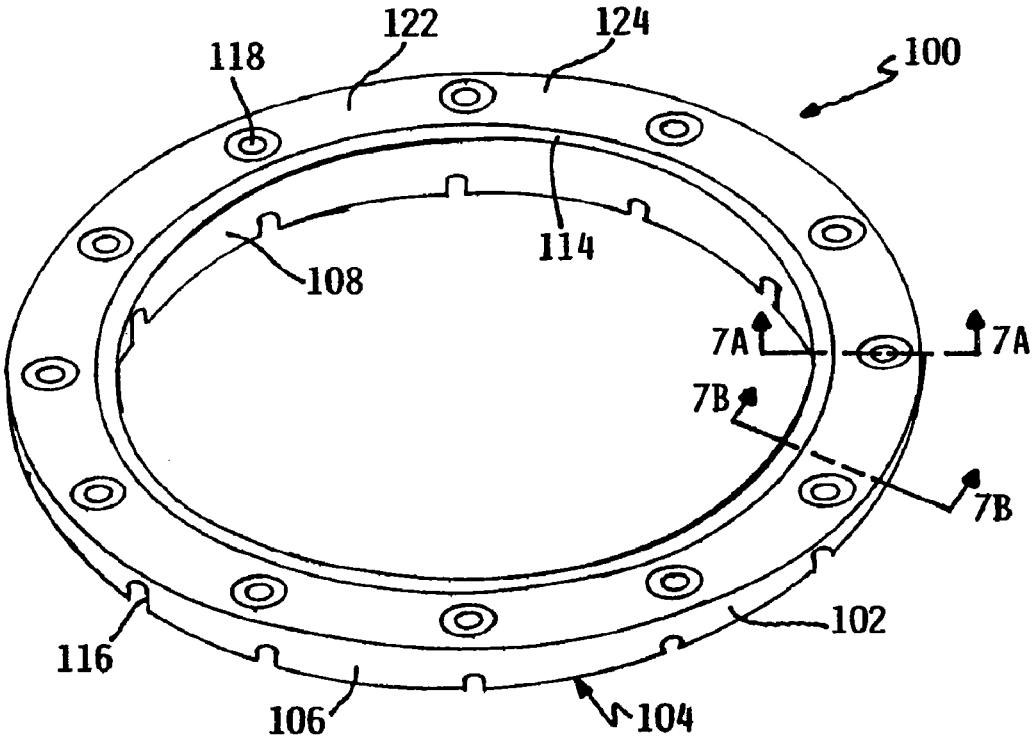
FIG. 1 is a perspective view of a CMP retaining ring according to an embodiment of the present invention.

Referring to FIG. 1, there can be seen a CMP retaining ring 100 according to an embodiment of the present invention. Retaining ring 100 comprises a lower or base portion 102 and an upper or backbone portion 122.

Figure 2:
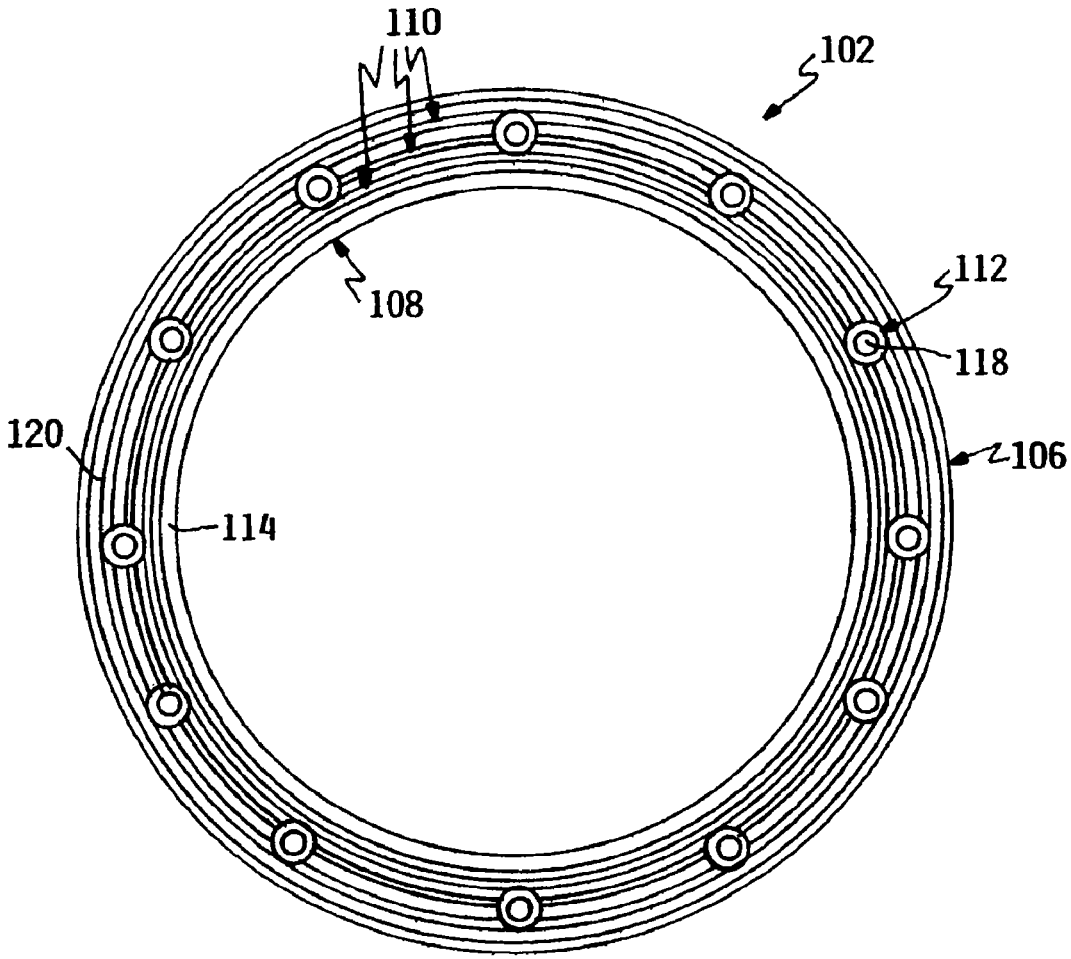
FIG. 2 is a view of the base portion of a CMP retaining ring according to an embodiment of the present invention.
Figure 4:
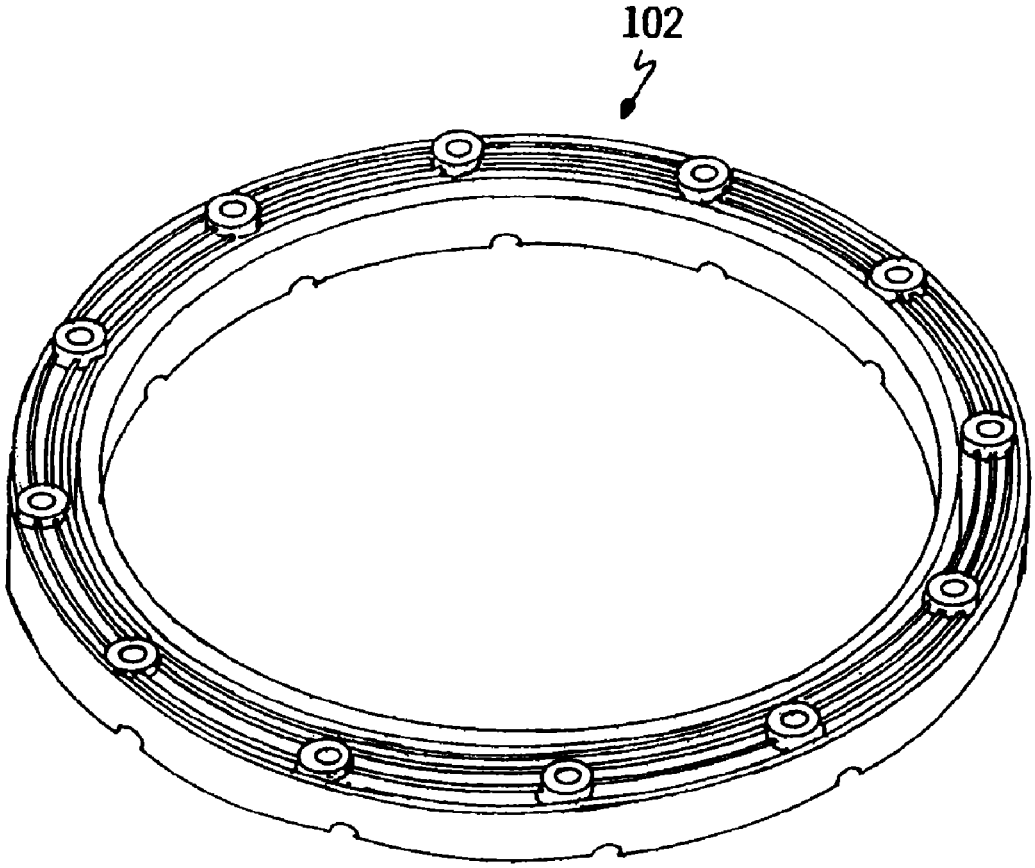
FIG. 4 is a view of the base portion of a CMP retaining ring according to an embodiment of the present invention.

Referring now to FIG. 2 and FIG. 4, a separated view of lower base portion 102 according to an embodiment of the present invention can be seen. Base portion 102 is generally defined by a flat bottom surface 104, an outer surface 106, an inner surface 108, an upper rim 114, and a recessed portion 120. Recessed portion 120 further includes a plurality of circular ribs 110 and bosses 112 with threaded insert holes 118. Ribs 110 serve to create a solid bond when upper backbone portion is overmolded onto base portion and provide strength to the retaining ring by preventing twisting or bending of the ring 100. Base portion 102 additionally includes channels or grooves 116 extending from outer surface 106 to inner surface 108. Ribs 110 are axial with respect to retaining ring 100, such that the ribs are substantially vertically oriented when retaining ring 100 is in use. The use of overmolding, to create a thermo-physical bond between multiple pieces, is disclosed in U.S. Pat. No. 6,428,729, the disclosure of which is hereby incorporated by reference.

Figure 3:
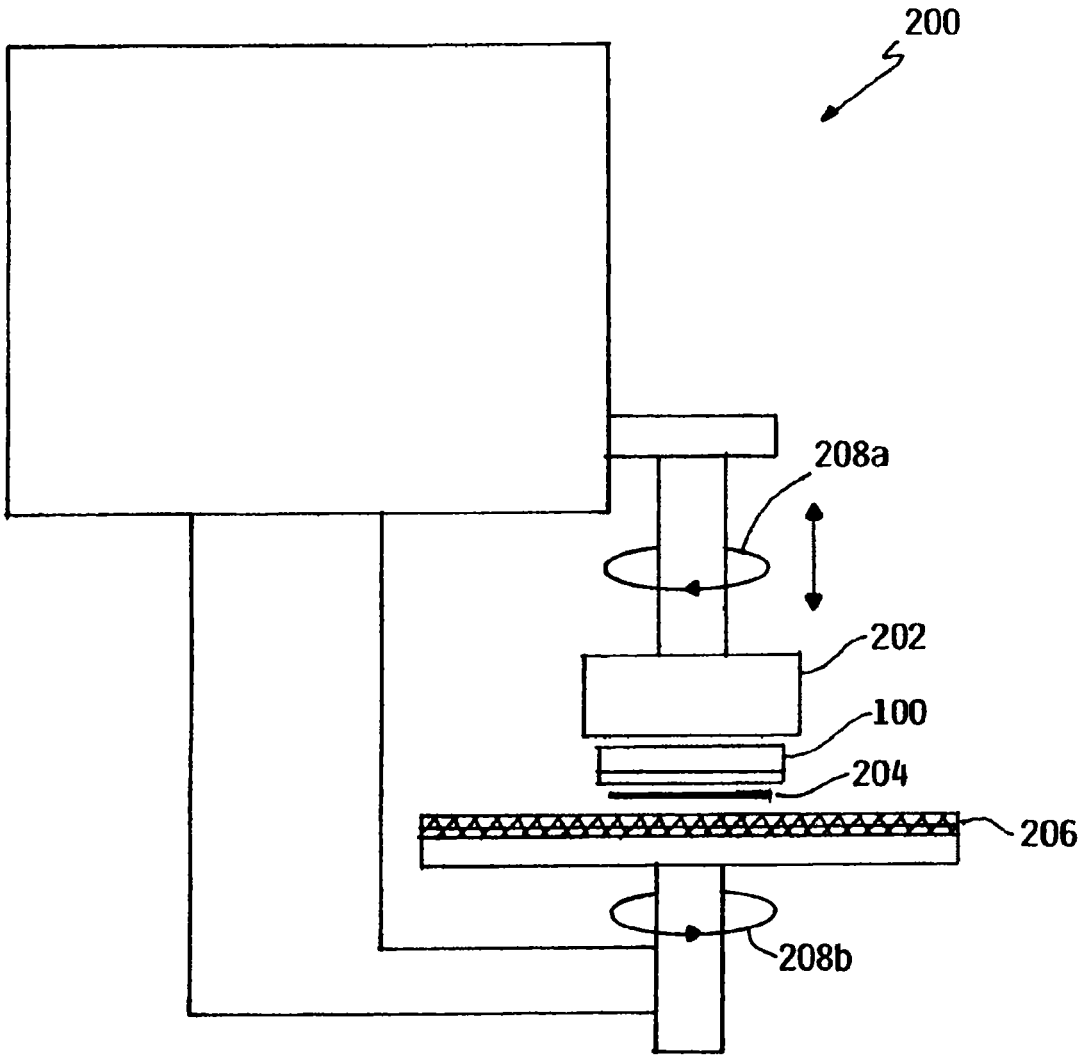
FIG. 3 is a diagram of a CMP system employing a CMP retaining ring according to an embodiment of the present invention.

Referring now to FIG. 3, there can be seen a chemical mechanical polishing system 200 utilizing a CMP retaining ring 100 according to an embodiment of the present invention. In practice, embodiments of the CMP retaining ring of the present invention, for example retaining ring 100, can be affixed by mounting fixtures on the ring to carrier head assembly 202 of a CMP system 200, with top surface 124 of retaining ring 100 flush with carrier head assembly 202. In some embodiments the retaining ring 100 can be fastened by inserting fastener inserts through threaded insert holes 118 and into corresponding holes on carrier head assembly 202. Fastener inserts can be inserted into retaining ring 100 during the injection molding process, they can be ultrasonically welded subsequent to the molding process, or they can be inserted manually. Fastener inserts can be comprised of any suitable material, including PEEK and stainless steel. A substrate 204 is supported within retaining ring 100 and is brought into contact with a polishing pad 206. Bottom surface 104 of retaining ring 104 contacts polishing pad 206. The polishing pad 206 operates to polish the substrates 204 due to opposing rotational forces imparted by axles 208*a* and 208*b*. Typically, a slurry, a chemically reactive liquid, or combination of these is applied to the pad 206 and used to enhance the rate at which material is removed from the substrate 204. Channels 116, with optionally divergent channel openings on the inner 108 and outer 106 surfaces in base portion 102 of retaining ring 100, facilitate the transport of the slurry or chemically reactive liquid to and from the outside of the retaining ring 100 to the substrate 204. Channels or grooves 116 may be created during the molding process, or machined into bottom surface 104 after the molding process.

Base portion 102 can be injection molded from a plastic, preferably polyetheretherketone (PEEK) or blends with other polymers that include PEEK or that may include other wear resistant plastic materials and blends. PEEK is advantageous in that it can support the wafer with little risk of chipping or cracking the substrate edge, while still providing high wear and abrasion resistance. Base portion 102 can also be comprised of PEEK that is extruded or compression molded and then machined. One of skill in the art will recognize that different polymers can be used to increase or decrease the wear resistance of base portion 102.

In some embodiments, after base portion 102 is molded, backbone portion 122 can be overmolded thereon. In other embodiments, the backbone portion 122 can be molded first and the base portion 102 is then overmolded onto the backbone portion 122. In other embodiments, the backbone portion 122 or the base 102 can be machined and the complementary base or backbone portion overmolded onto the machined piece respectively.

Figure 5:
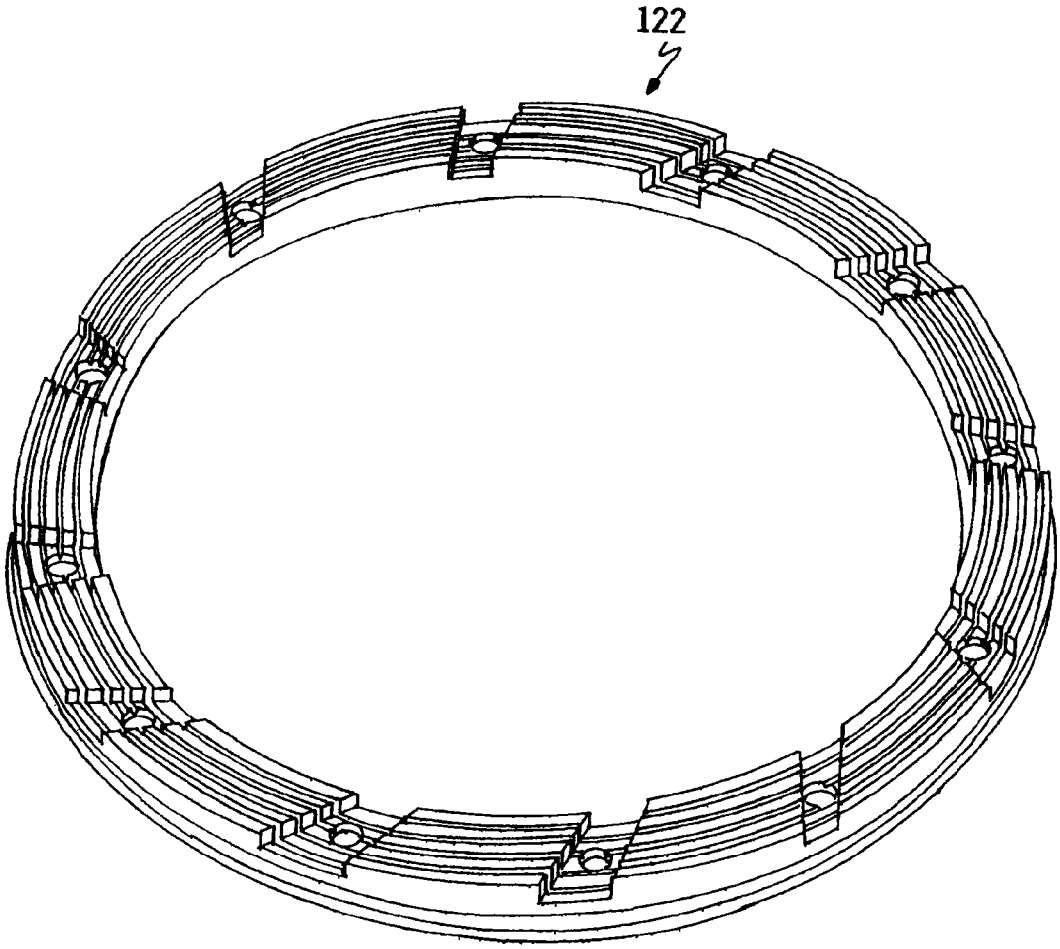
FIG. 5 is a view of the backbone portion of a CMP retaining ring according to an embodiment of the present invention.

FIG. 5 shows a view of what an overmolded upper portion or backbone portion 122 would look like as a separate piece according to an embodiment of the present invention. The circular ribbing 110 in base portion 102 helps create a solid bonding surface with increased contact area between backbone portion 122 and base 102. Backbone portion 122 can be comprised of a ceramic material or other filler/additive. For example, the ceramic material may be dispersed in a polymer like PEEK (an example of this is STAT-PRO®, a conductive ceramic PEEK from Entegris Inc.). The ceramic material can then be used to tailor the structural rigidity, shear resistance, thermal conductance, or other property of the backbone portion 122. The backbone portion 122 structurally enhances the ring's stiffness based on its modulus. The backbone portion may have a flexural modular range that includes, but is not limited to, 600,000 to 1,400,000 psi. The backbone portion 122 material can be filled into the recessed portions 120 of lower base portion 102, so that it is coplanar with upper rim 114 and bosses 112. The rigidity that a ceramic material provides will help provide solid equipment attachment and will reduce damage to the ring from the shearing, rotational, and other forces imparted by the carrier head to the ring 100.

Figure 6:
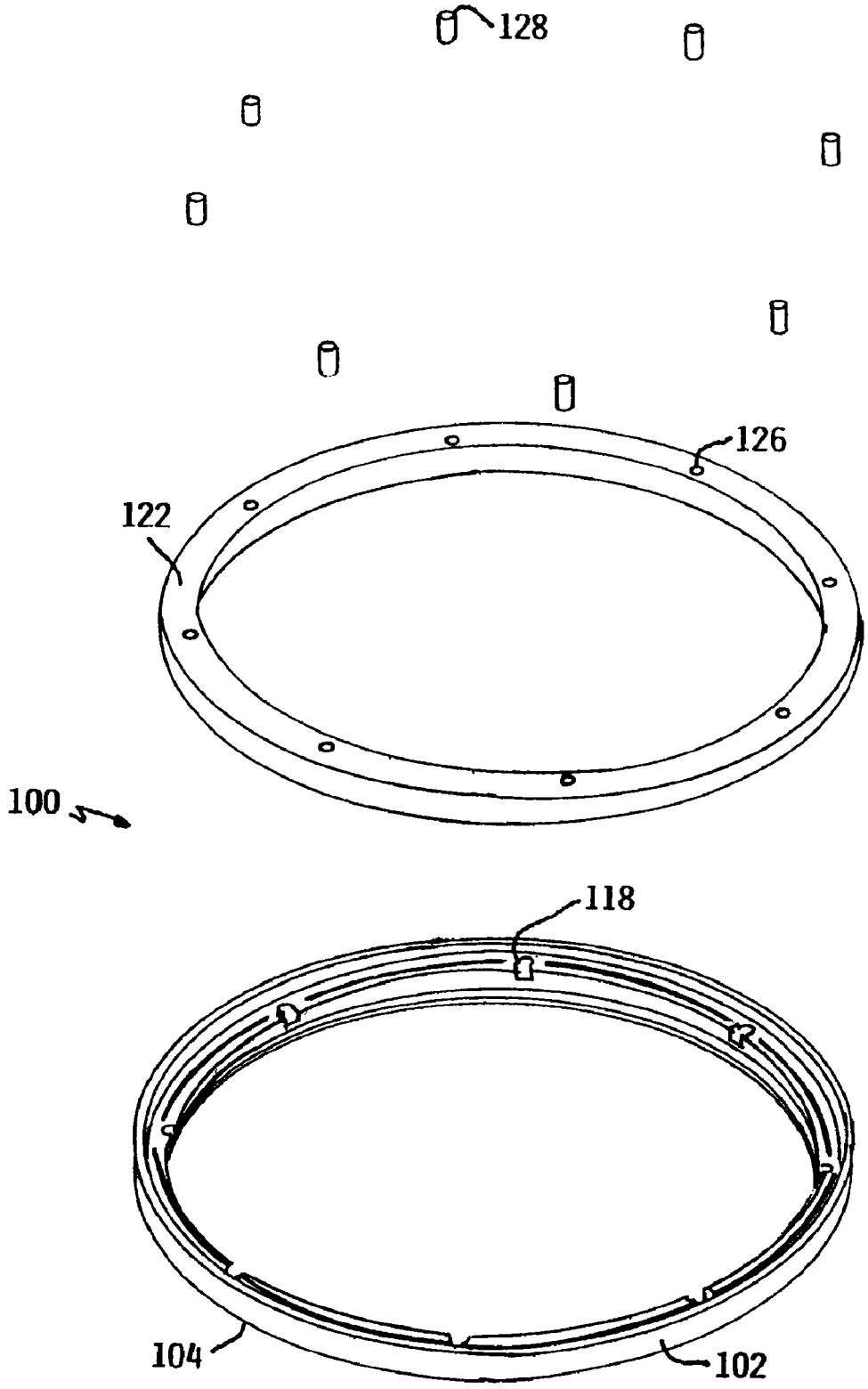
FIG. 6 is an exploded view of a CMP retaining ring according to an embodiment of the present invention.

FIG. 6 illustrates an exploded view of an embodiment of the retaining ring 100 of the present invention. A ring base portion 102 is shown having one or more ribs 110 on a non-fluid contacting side and optional holes 118 for inserts. Retaining ring 100 also includes a backbone portion 122 that has mounting fixtures 126. The mounting fixture 126 may for example include holes for inserts 128 which can be threaded or include mounting protuberances (not shown) which can also be threaded for mounting the assembled device to a tool. The holes 118, 126 for inserts 128 can optionally be molded to include threads or other fasteners. In some embodiments, an insert such as Heli-Coil® Standard and Screw-Lock Inserts or other threaded or fastener insert may be used. The backbone portion 122 can have ribs 130 that mate with the ribs 110 on the base portion 102. Alternatively, the backbone portion 122 can be molded with ribs 130, and the ring base portion 102 overmolded onto the backbone portion 122 to fill in the backbone portion rib channels 136. The base portion surface 104 that contacts a polishing pad can include raised or recessed pad contacting structures termed pads or foil shaped pads, described more fully below.

The retaining ring may use or comprise threaded inserts 128. In other embodiments the retaining ring can comprise one or more tapped threads formed directly into the ring without the use of inserts. An over-molded retaining ring with two materials, for example the backbone portion being the stiffer of the two, can provide greater pull-out and torque-out strength than with just the base portionmaterial alone.

Figure 7A:
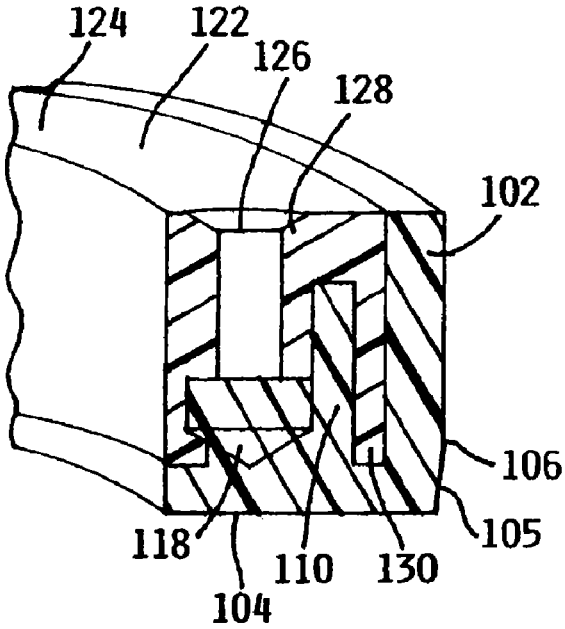
FIG. 7A is a cross sectional view of a CMP retaining ring taken along the line 7A-7A in FIG. 1.
Figure 7B:
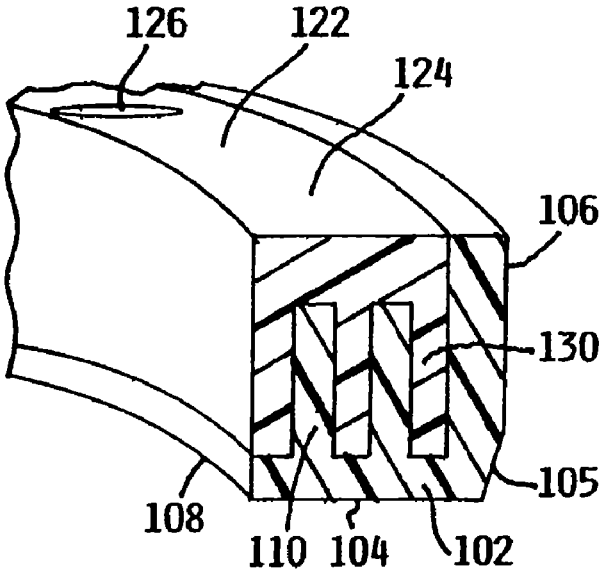
FIG. 7B is a cross sectional view of a CMP retaining ring taken along the line 7B-7B in FIG. 1.

FIGS. 7A and 7B illustrate cross sections of an embodiment of the invention. FIG. 7A shows a cross section taken at an insert hole 126 while FIG. 7B shows a cross section between insert holes. The backbone portion ribs 130 are shown interlocking or engaging the ribs 110 of the base 102. In various embodiments the ribs 130 of the backbone portion 122 can be formed by molding, machining, any combination of these, or other suitable process to make the ribs. The base portion ribs 110, outer wall 106, and bottom pad contacting surface 104 may be formed by molding or machining or any combination of these. The base portion 102 can have a beveled edge, for example a beveled outside edge 105 which can form part of the base portion pad structures. An insert 128, which can be threaded, is shown through a hole 126, cavity or recessed portion of the backbone portion 122 and penetrating into a portion 118 of the base portion 102. The base portion 102 and backbone portion 122 may be held together by bonding of the base portion and backbone portion materials during molding or by use of an adhesive, by the action of a threaded bolt or screw in the inserts, or any combination of these or other fixture mechanisms. As depicted in FIGS. 7A and 7B, base 102 and backbone 122 are meshed, or interlaced, with one another following the overmolding process.

Figure 8A:
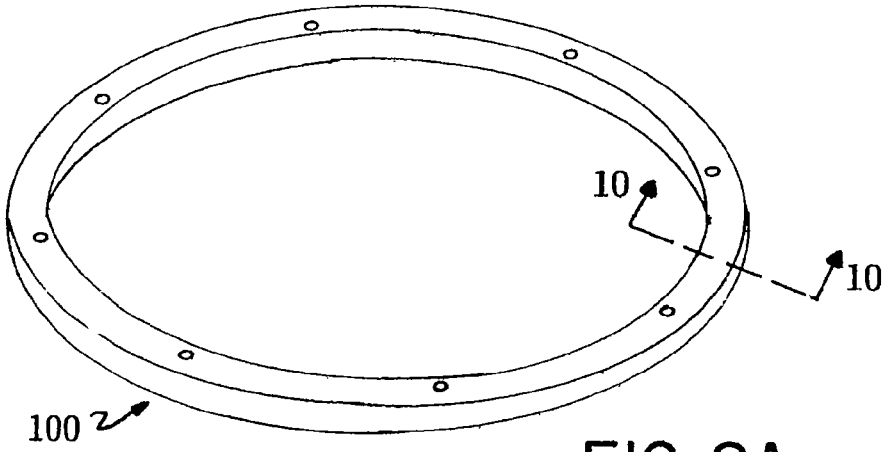
FIG. 8A is a perspective view of a CMP retaining ring according to an embodiment of the present invention
Figure 8B:
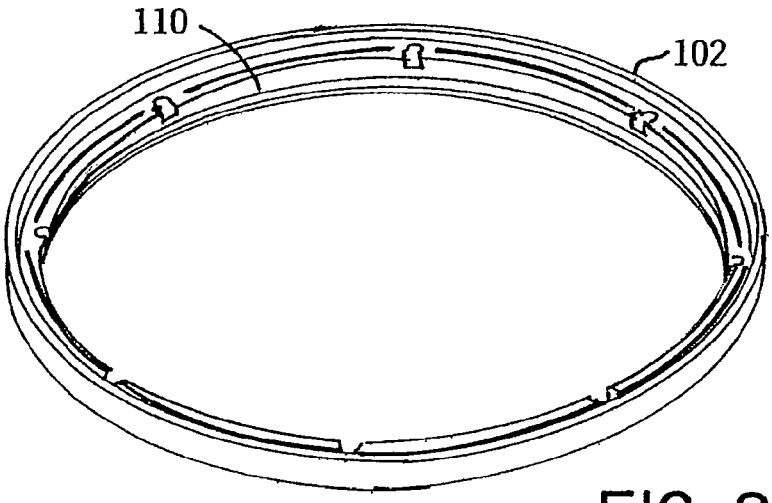
FIG. 8B is a perspective view of a base portion of a CMP retaining ring according to an embodiment of the present invention.
Figure 8C:
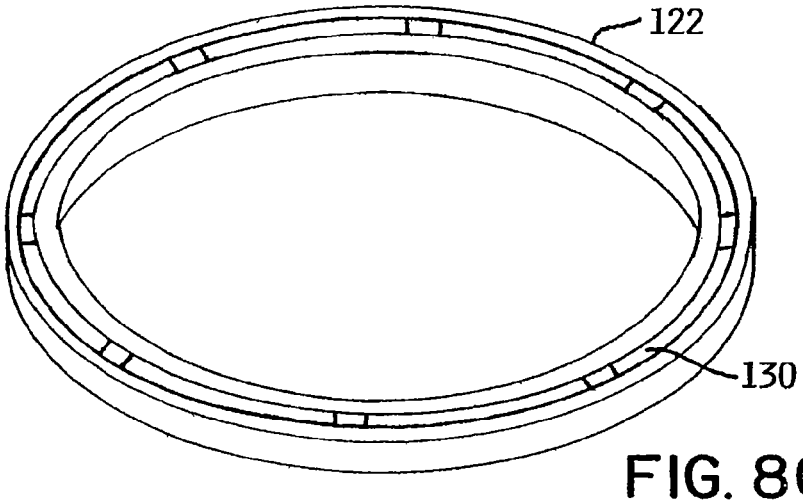
FIG. 8C is a perspective view of a backbone portion of a CMP retaining ring according to an embodiment of the present invention.

FIGS. 8A-8C illustrate ribs 110, 130 which may be present in various embodiments of the invention. The backbone portion 122 and base portion ring 102 can have ribs that can mate and be bonded together using an over-molding process. The $1^{st}$ shot may be coated or primed to increase the bond to the $2^{nd}$ shot of material.

Figure 9A:
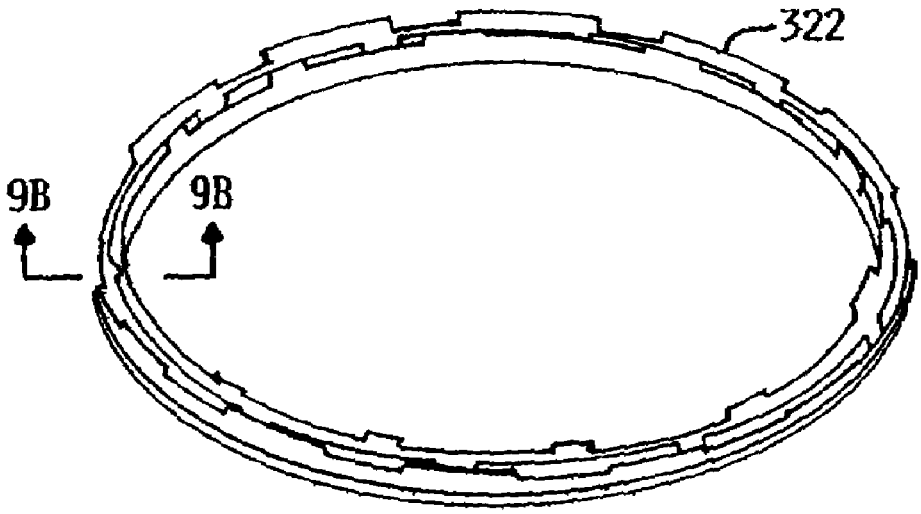
FIG. 9A is a perspective view of a backbone portion of a CMP retaining ring according to an embodiment of the present invention.
Figure 9B:
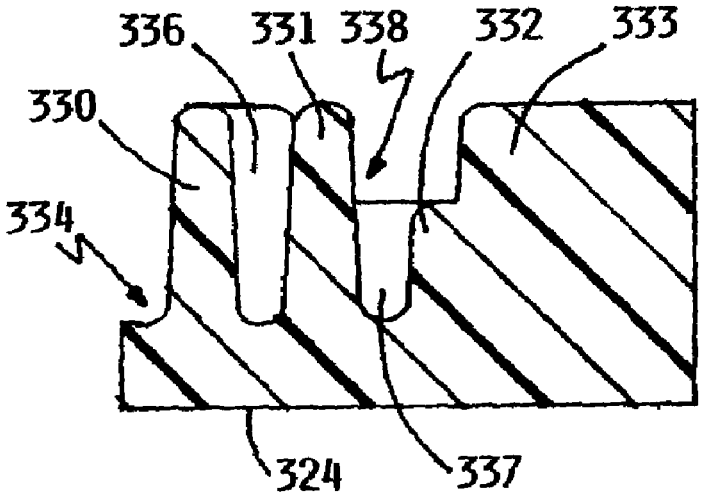
FIG. 9B is a cross sectional view taken along the line 9B-9B in FIG. 9A.

FIGS. 9A and 9B illustrate a backbone portion 322 of a retaining ring according to an embodiment of the present invention. Backbone portion 322 may include ribs 330-333 of varying size and shape. The ribs 330-333 of the backbone portion 322 can mate with corresponding ribs on the base portion where machined base portion and backbone portion rings are joined. The backbone portion ribs can include rib channels 336, 337. Ribs may include one or more voids 338 of varying size and shape along a given rib. There can be one or more rows of ribs 330-333 or one or more rows of channels 336, 337 from the inner to the outer surface of the backbone portion 322. The rib channels 336, 337 and rib voids 338 may be filled with overmolded base portion material or mated with a corresponding machined part and fastened together. The rib channel and rib void size can be chosen depending upon the strength, structural rigidity, and base portion bonding requirements for the retaining ring. The high surface area of the ribs, rib channels, and optional rib voids increase the bonding area with the base. The ribs, channels, and rib voids promote stiffness in the retaining ring. The top backbone portion surface 324 contacts the machine tool carrier head assembly. The backbone portion stop 334 provides a bonding surface for a portion of the base portion along the outer diameter of the retaining ring.

The ribbed structure of the backbone portion adds structural rigidity to the backbone portion in the completed retaining ring. The ribs also provide for increased surface area for bonding the base portion layer to the backbone portion. The ribs create proper wall sections for injection molding that allow for a first shot of material and an over-molded second shot of material. The size of the ribs and troughs can be chosen to allow for the injection molding. In some embodiments the ribs can have a height of about 2.5 cm or less from trough to top, preferably less than about 1 to about 1.5 cm. In preferred embodiments there are at least two ribs and preferably three ribs extending from each respective portion in opposite axial directions, the respective ribs being in interlacing engagement with sidewalls of the ribs preferably having parallel faces. The interlacing portions of the ribs preferably extend at least 25 percent of the axial thickness of the rib.

The backbone portion can comprise a moldable composite thermoplastic material. One example of a useful material for the backbone portion includes processable rigid rod polymers based on a string of substituted and unsubstituted phenylene rings that produce a highly rigid structure. Small amounts of these kinds of resin can be used to reinforce other polymers used for the backbone portion such as PEEK. Examples of rigid rod polymers that may be used include but are not limited to Parmax SRP (from Mississippi Polymer Technologies), Celazole® PBI (polybenzamidazole) (CELAZOLE is a registered trademark of Celanese Advanced Materials, Inc.), PEEK w/ PBI fiber and PBO (polyphenylene benzobisoxazole). The moldable composite may be a thermoplastic material that contains a ceramic filler that provides structural rigidity to the retaining ring which has one or more channels with divergent inlets and outlets. The composite thermoplastic can optionally have good thermal conductivity. Examples of such composite materials may include those disclosed in U.S. Pat. No. 5,024,978 the contents of which are incorporated herein by reference in their entirety into the present disclosure. The composite thermoplastics can include fiber-reinforced ceramic matrix composites. The inorganic or ceramic reinforcing fibers can be dispersed with thermoplastic solids that have been melted. These heated liquid dispersions can be used in subsequent molding operations to form the backbone portion ring. Inorganic or ceramic materials may include powdered glasses, such as powdered aluminosilicate glasses or powdered borosilicate glasses, powdered aluminosilicate glasses which are thermally crystallizable to yield refractory glass-ceramic matrices such as matrices comprising .beta.-spodumene, anorthite, cordierite, or other phases, and crystalline materials useful for composite manufacture such as but not limited to for example, alumina, zirconia, silicon carbide, silicon nitride, combinations of these and other materials. A variety of reinforcing particles and or fibers including those selected from the group comprising fibers of carbon, silicon carbide, glass, silicon nitride, alumina, mullite or similar materials may also be used. In selecting particles and or fibers for the filler, the physical form in which the particle and or fibers may be chosen according to the requirements of subsequent processing or the configuration or properties desired in the composite preform or end product. Thus, for example, the fibers may be provided in the form of a woven or non-woven fiber fabric, fiber tows, i.e., fiber bundles or other groups of fibers forming multi-fiber yarns, cords or twine can be selected. Particle shapes may include but are not limited to plate-like, spherical, oblong, irregularly shaped, or any combination of these.

The backbone portion of the retaining ring is a material that is mechanically stiffer than the wear resistant base portion material. Some embodiments of the retaining ring may comprise a metal containing backbone portion which can include a machined metal backbone portion with ribs, a backbone portion made from sintered powdered metal formed in the shape of a backbone portion with or without ribs, a backbone portion made from an injection molded metal. The geometry of a metal backbone portion can be similar to plastic backbone portion. It can include ribs for structure and to allow for even wall sections for the over-molding of a second shot of polymer to form the base. The metal backbone portion may also incorporate undercuts with respect to the second shot for mechanical bonding.

One advantage of the all polymer retaining ring in embodiments of the invention is that the polymers can be formulated or treated so they have reduced amounts or are free of ionic impurities for microelectronic manufacturing applications and can be chosen and outgas very little, thwarting the trace contamination from sodium, aluminum, iron, copper, lithium, and other inorganic elements that commonly leach out of conventional ceramic retaining rings. Polymers can also allow one single CMP ring material set for the entire range of CMP processes (i.e. Oxide, Tungsten, Copper). A single ring per wafer lowers overall consumables costs as one material set can handle rings for an entire fab line. The polymer material set can be chosen to be chemically compatible and handle a wide array of chemistries including a broad pH range encountered in CMP processing. The polymers can be chosen for their hydrolytic and dimensional stability in liquid or aqueous slurry environments such that substrate polishing rates and or polishing uniformity across the substrate are maintained with in process tolerances.

Figure 10A:
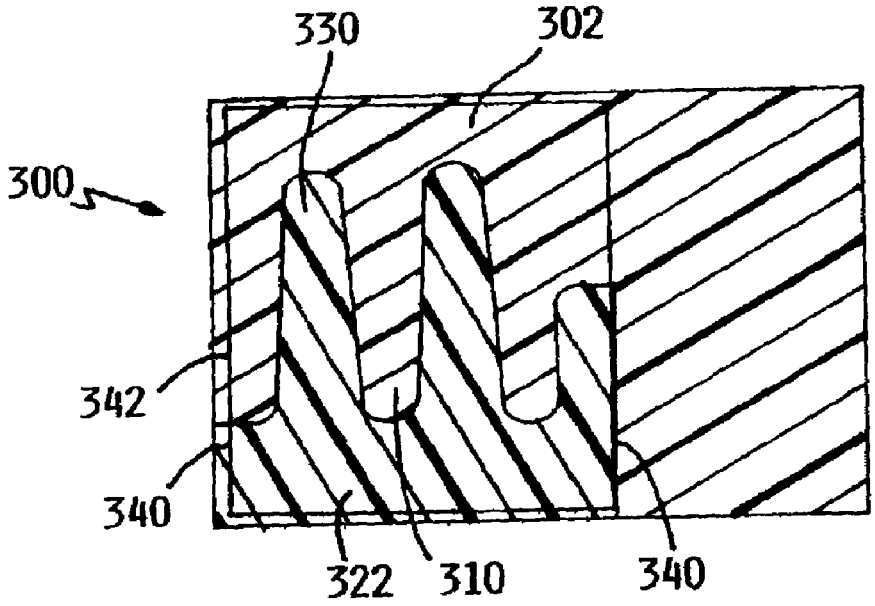
FIGS. 10A and 10B are cross sectional views taken along the line 10-10 in FIG. 8A.
Figure 10B:
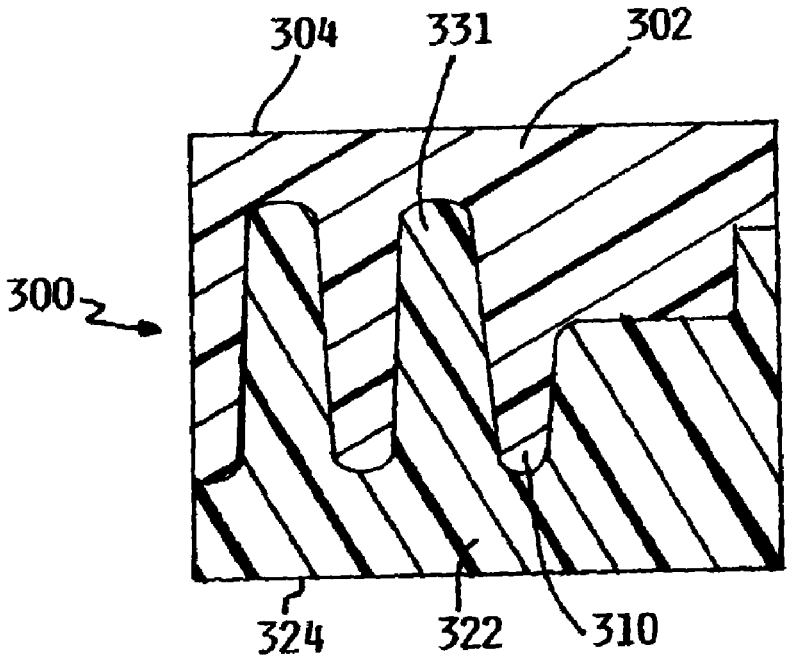

FIGS. 10A and 10B detail an inverted cross section of a molded retaining ring 300 according to an embodiment of the present invention. FIG. 10A illustrates molded base portion flashing 340 on the inside and outside diameters of the backbone portion 322 that can be formed in a molding operation. The flashing thickness can be adjusted. One or more surfaces of the ring may be finished by a post molding machining operation to remove all or a portion of the flashing, as shown in FIG. 10B. Post machining can remove the flashing to a final surface and finish illustrated by the solid line 342 in FIG. 10A. As illustrated by the tongue and groove structure of the base portion and backbone portion in FIGS. 10A and 10B, a cross section of a retaining ring could be characterized by one or more overlapping regions of base portion and backbone portion material.

FIG. 10B details a cross section of the retaining device 300 that illustrates an embodiment with base portion flash removed from the article in an optional post bonding or post molding process. Following machining, surfaces that do not contact the pad can be further optionally finished with about 600 grit or finer polishing paper. For surfaces that contact the pad or substrate, polishing paper of about 1500 grit or finer can be used. For less critical substrates or pads, lower grit polishing or as machined surfaces can be used.

Figure 11:
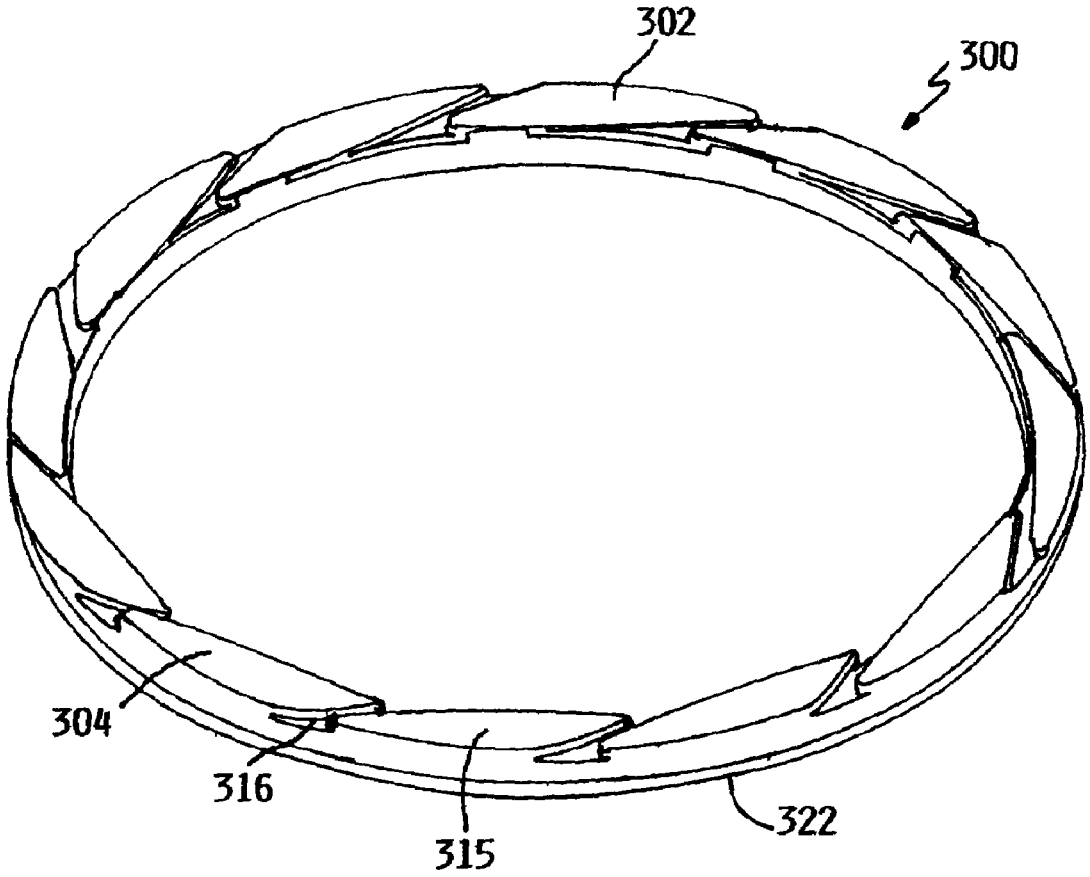
FIG. 11 is a perspective view of the bottom side of a CMP retaining ring according to an embodiment of the present invention.
Figure 17:
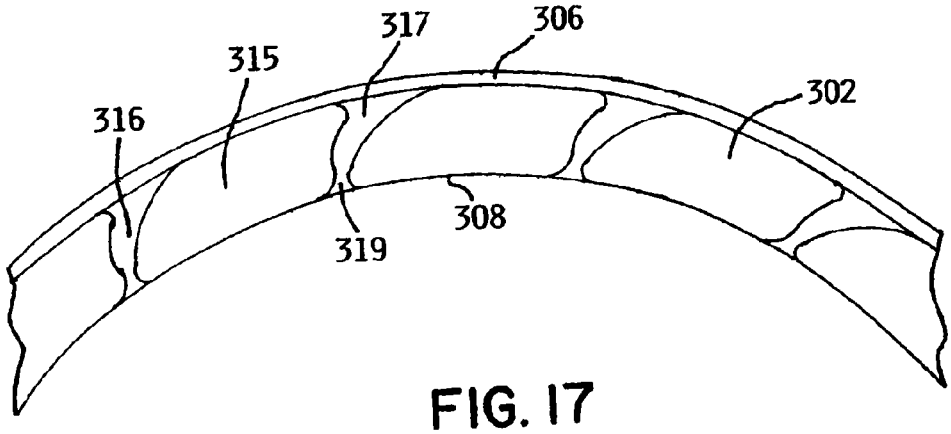
FIG. 17 is a perspective view of a portion of the bottom of a CMP retaining ring according to an embodiment of the present invention.

FIG. 11 illustrates a perspective view of a retaining ring 300 having a pad contacting surface 304 of the ring base portion 302 with one or more raised pad contacting areas 315 with recessed channels or grooves 316 between them. The grooves or channels 316 can have divergent inlet, divergent outlets, or any combination of these. The channels 316 and raised pads 315 can be positioned or formed circumferentially about the ring and permit fluid flow, for example a polishing fluid or slurry, between the inner and outer diameters of the ring when it contacts a polishing pad and is rotated during use. While the description of the retaining ring, base, and backbone portion have been described and illustrated with ring shapes, other shapes may be possible provided that the more generally retaining base portion can be mounted to a moving carrier and has an inner surface perimeter that holds the substrate and preferably corresponds to about the perimeter of the substrate. The pads 315 with fluid channels 316 between them can have an outer edge that essentially parallels the outer edge or circumference of the ring 300 and the pads 315 can have an inner edge with one or more surfaces that essentially parallel the inner edge of the ring 300. The pads 315 can be spaced apart from each other and form variously shaped channels 316 as illustrated in FIG. 13, FIG. 14, FIG. 16, FIG. 17, FIG. 25, FIG. 26, and FIG. 27. In some cases the slurry grooves or channels may be curved or parallel between two adjacent pads. In some embodiments, as shown in FIG. 17, the channel or slurry groove may be tapered. The channels or slurry grooves can have a divergent, widened, or funnel shaped channel on the inner side, outer surface, or any combination of these. The divergent channel surfaces improve the transfer of fluid between the inner and outer ring surfaces and the retained substrate. Edges of the pad structure can be beveled to reduce wear on the polishing pad and retaining ring. The depth of the channels can be modified (made deeper or more shallow) to accommodate or modify the flow of fluid (polishing slurry or other liquid) into and out of the inner ring area (where substrate is located). The channels can have one or more divergent ends on the inner ring diameter surface, outer ring diameter surface or both. The shape of the divergent channels or grooves on the inner and outer sides of the ring can be asymmetric in volume to modify fluid velocity in the region of the ring and facilitate movement of fluid into or away from the substrate. The shape of the divergent channels may be modified for particular slurry composition, viscosity, particle size, and rotation rate of the retaining ring to achieve a desired polishing or material removal rate and or uniformity.

Figure 12:
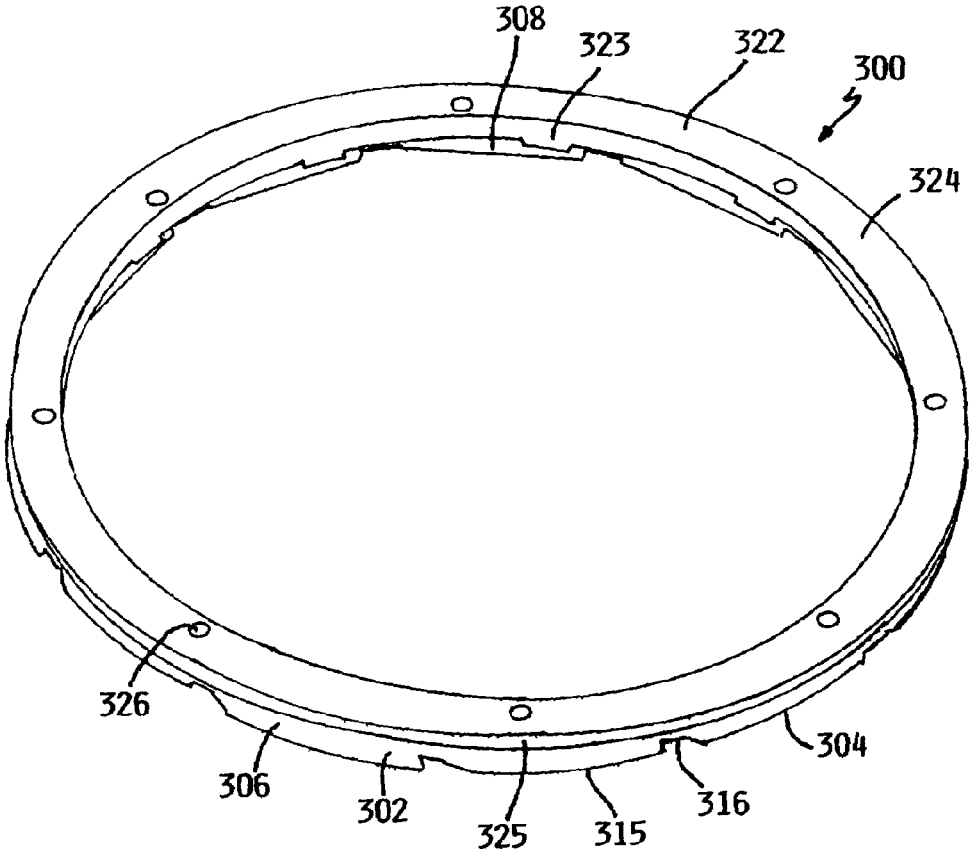
FIG. 12 is a perspective view of a CMP retaining ring according to an embodiment of the present invention.

The ring shaped structure 300 or carrier assembly illustrated in FIGS. 11 and 12 can be used to retain a substrate for polishing or other surface treatment. In some embodiments, the retaining ring 300 has a shape that permits mounting to a rotating plate and retention of circularly shaped substrates. The retaining ring has an inner surface 308 or diameter exposed to contact a peripheral edge of a substrate to be polished; the substrate is held against a polishing surface or pad. The retaining ring 300 can comprise a ring shaped base portion 302 that contacts a polishing pad. The ring shaped base portion 302 can be made of a material that comprises a wear resistant material and that retains its shape under the load of the tool. The ring shaped base portion 302 can include a pad contacting surface side 304, an inner edge or surface 308, an outer edge or surface 306, and one or more ribs and/or rib channels (shown in FIGS. 10A and 10B). The pad contacting surface 304 of the ring shaped base portion 302 can comprise one or more channels or grooves 316 and one or more pads 315 between the inner edge surface 308 and an outer edge surface 306 of the ring shaped base portion 302.

The retaining ring 300 can further comprise a ring shaped backbone portion 322. The ring shaped backbone portion 322 can be made of a material that is different from the ring shaped base portion 302. In some embodiments, the ring shaped backbone portion 322 comprises a stiffer and more wear resistant material than the base, for example a ceramic thermoplastic composite. The ring shaped backbone portion 322 can include one or more mounting fixtures 326, an inner edge surface 323, an outer edge surface 325, and one or more ribs and/or rib channels (shown in FIGS. 10A and 10B). The ring shaped base portion 302 and ring shaped backbone portion 322 are joined along an interface that comprises bonding surfaces between their corresponding ribs and channels as shown in FIGS. 10A and 10B. These bonding surfaces can be joined by chemical bonding, welding or fusion bonding, mechanical bonding, overmolding one material onto the other, or any combination of these. The base portion material and the backbone portion material can form cohesive bonds along the surfaces of the ribs and rib channels where they contact. The mounting fixtures can comprise structures that couple the ring shaped backbone portion to a tool or rotating platen.

The channels or grooves in the surface of the base portion of the retaining ring can further include one or more divergent openings which may be inlets, outlets or combination of these between the inner and outer surfaces of the retaining ring. The channel cross section can have a rectangular shape, a radius shape, or other shapes. The shape of the cross section of the channel can be chosen to reduce or eliminate low flow areas or dead volumes in the channels, channels with a radius shape can provide a more uniform slurry of liquid flow velocity along the channel or groove surface. In some embodiments, the void volume of the divergent openings in the base, for example where channel walls are not parallel, can be greater than the channel void volume (where channel walls are parallel). In some embodiments the base portion material has higher wear resistance than the backbone portion. The ring shaped base portion of the retaining ring can comprise a wear resistant thermoplastic like PEEK or a co-polymer of PEEK. The ring shaped backbone portion of the retaining ring can comprise a ceramic filled thermoplastic material that is stiffer than the base portion of the retaining ring. The ceramic material that may be used as a backbone portion can have a higher density than the material used for the base.

Figure 13:
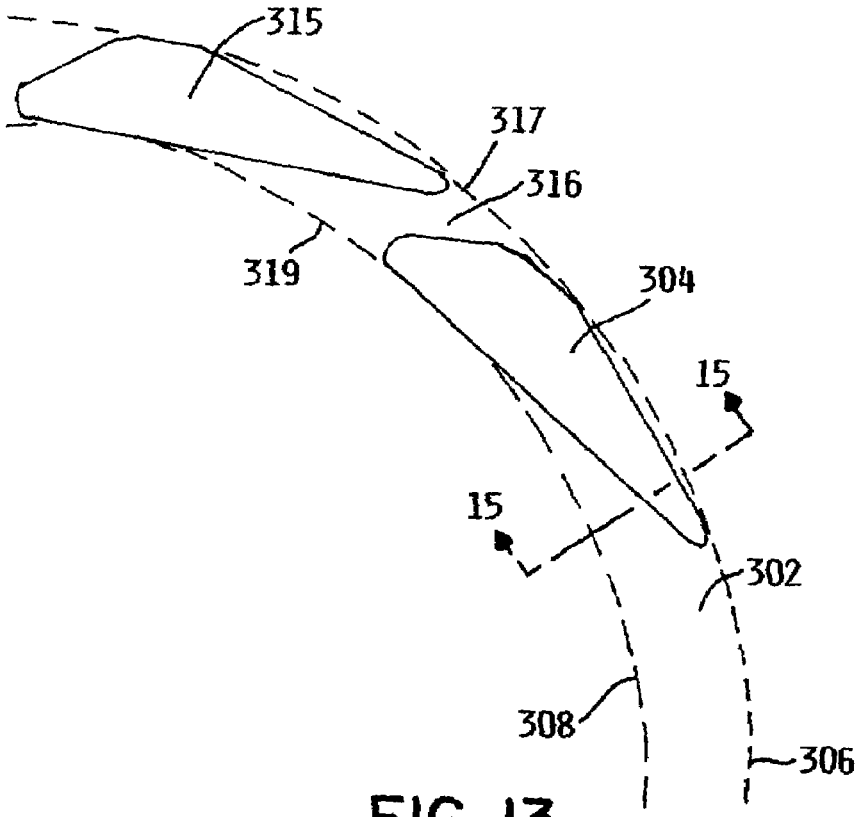
FIG. 13 is a perspective view of a portion of the bottom of a CMP retaining ring according to an embodiment of the present invention.
Figure 14:
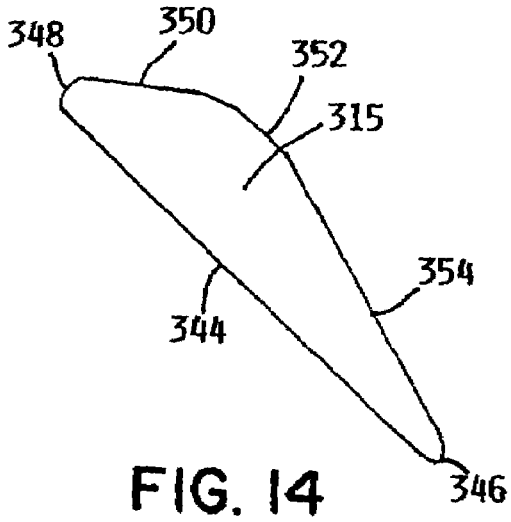
FIG. 14 is a close-up view of a pad contacting area of a CMP retaining ring according to an embodiment of the present invention.

An embodiment of the structure of the retaining ring pads 315 or foils is illustrated in FIG. 14. The shape of the channels 316 formed between pads 315 is illustrated in FIG. 13. One advantage of the present invention is that the channels 316 improve the utilization of polishing slurry and reduce costs of polishing. The channels 316 or grooves between the retaining ring pads 315 provide for fluid, liquid, or slurry flow which can be along a groove formed by a leading edge of one pad structure and the bottom inner edge of an adjacent pad structure. The divergent inlet on the inner diameter of the ring of these channels can be shaped by the bottom inner edge of one pad and the leading edge and leading surface of the adjacent pad or foil. The divergent outlet on the outer diameter of the ring can be formed by the bottom inner pad edge and trailing edge of one pad with the leading edge and outer edge of an adjacent pad. The channel shape promotes transfer of fluid and slurry between the inner diameter of the ring (where the substrate is held) and the outer diameter of the ring.

Figure 15:
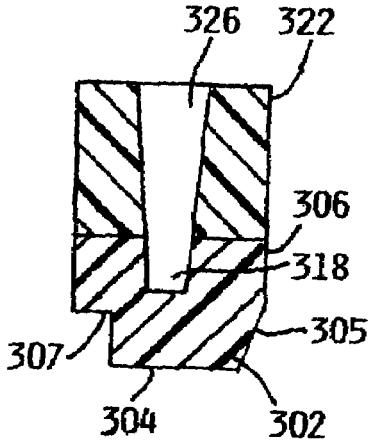
FIG. 15 is a cross sectional view taken along the line 15-15 in FIG. 13.
Figure 16:
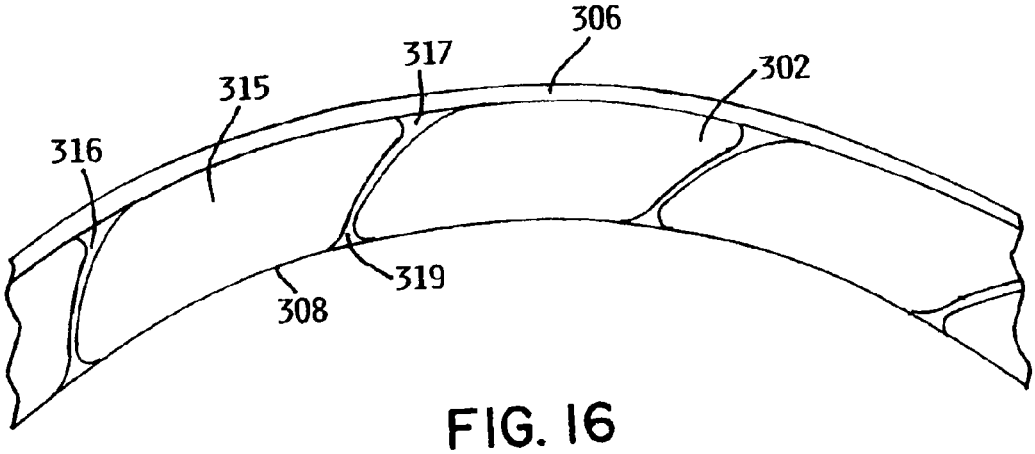
FIG. 16 is a perspective view of a portion of the bottom of a CMP retaining ring according to an embodiment of the present invention.

In FIG. 13, the shaped channel inlet 319 (opens to the inner ring surface or edge) and shaped channel outlet 317 (opens to the outer ring surface or edge) can be varied and, for example, the void volume of the inlet 319 can be made large than the void volume of the outlet 317. FIG. 15 shows a cross section along that illustrates an optional bevel 305 on the outer pad surface. The adjacent pads can be positioned relative to one another to form a channel or groove. The channel walls may be parallel or non-parallel. Inlet 319 and outlet 317 may be created during the molding process, or machined into retaining ring 300 after the molding process.

Referring now to FIG. 14, the one or more pads 315 or foils that form channels along the ring can have an inner pad surface 344 that can have an edge or portion of its perimeter that is tangent, parallel, or curvilinear with a portion of the inner ring surface. A portion of the pad 315 can be offset from the inner ring surface. The trailing 346 and leading 348 edges can optionally be rounded, beveled, or otherwise formed with a radius. A rounded shape is advantageous for fluid flow and reduces particle generation during handling because it can prevent snags with gloves or polishing pad irregularities. The leading surface 350 of the pad can form a channel or groove with the inner pad surface of an adjacent pad. A portion of the outer pad surface 352 and beveled trailing surface 354 can be tangent, parallel, or curvilinear with a portion of the outer ring surface. The shape of the pad from the leading edge 348 to the outer pad surface 352 and trailing edge 346 can be chosen to have a length that is greater than the length from the leading edge 348 to the trailing edge 346 along the inner pad surface 344.

FIG. 15 shows the beveled edge 305 of a pad structure 315 along the outer edge 306 of the ring along the base. A hole 318, 326, recess, or cavity which can be threaded or used for a mounting insert or mounting protuberance is shown traversing the backbone portion 322 and base portion 302. In some embodiments (not shown) the hole may only traverse the base portion 302. FIG. 15 also illustrates a step 307 formed between the divergent inlet recessed into the base portion surface and the surface of the base portion that contacts the pad 304. The size of this step can vary along the pad structure or pad.

Figure 18:
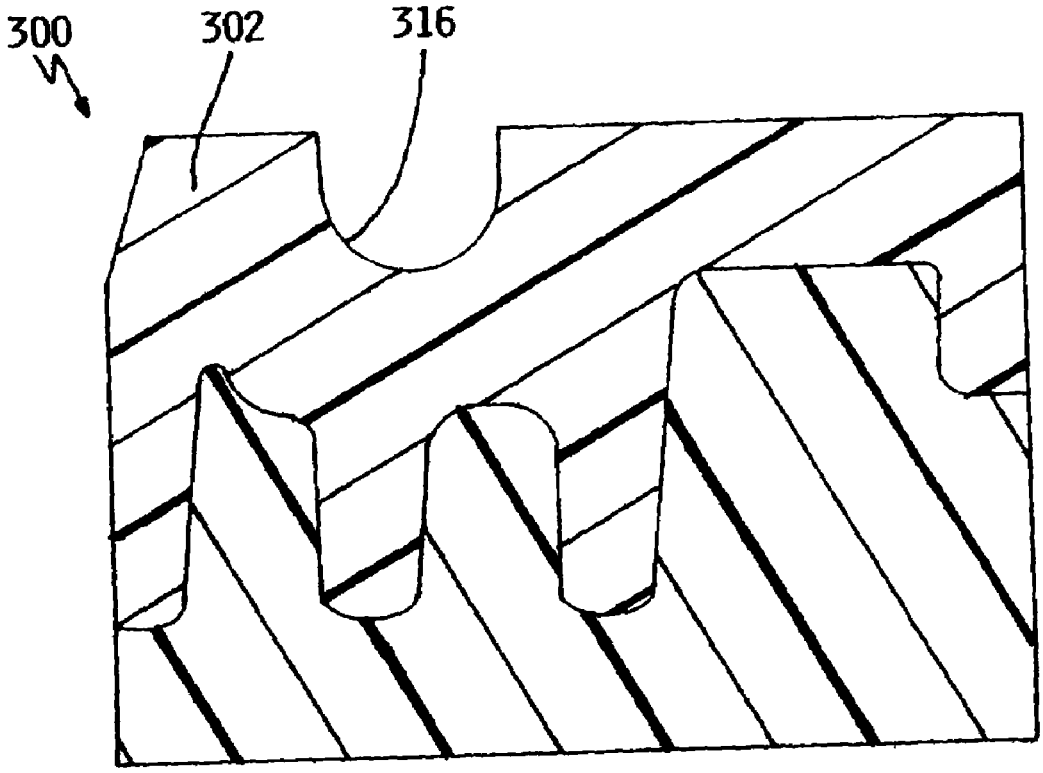
FIG. 18 is a cross sectional view of a CMP retaining ring according to an embodiment of the present invention.

The depth of the channel or groove of the pad can be made to handle the slurry flow requirements between the inside and outside of the retaining ring during a polishing process. As shown in FIG. 18, the cross section of a slurry groove 316 in base portion 302 can include a smooth radius within the groove. In some embodiments the groove has a rectangular cross section. In various embodiments of the grooves, the deepest portion of the groove can be about 0.5 cm or less. In some embodiments the deepest portion of the channel can be about 0.25 cm or less.

Figure 19:
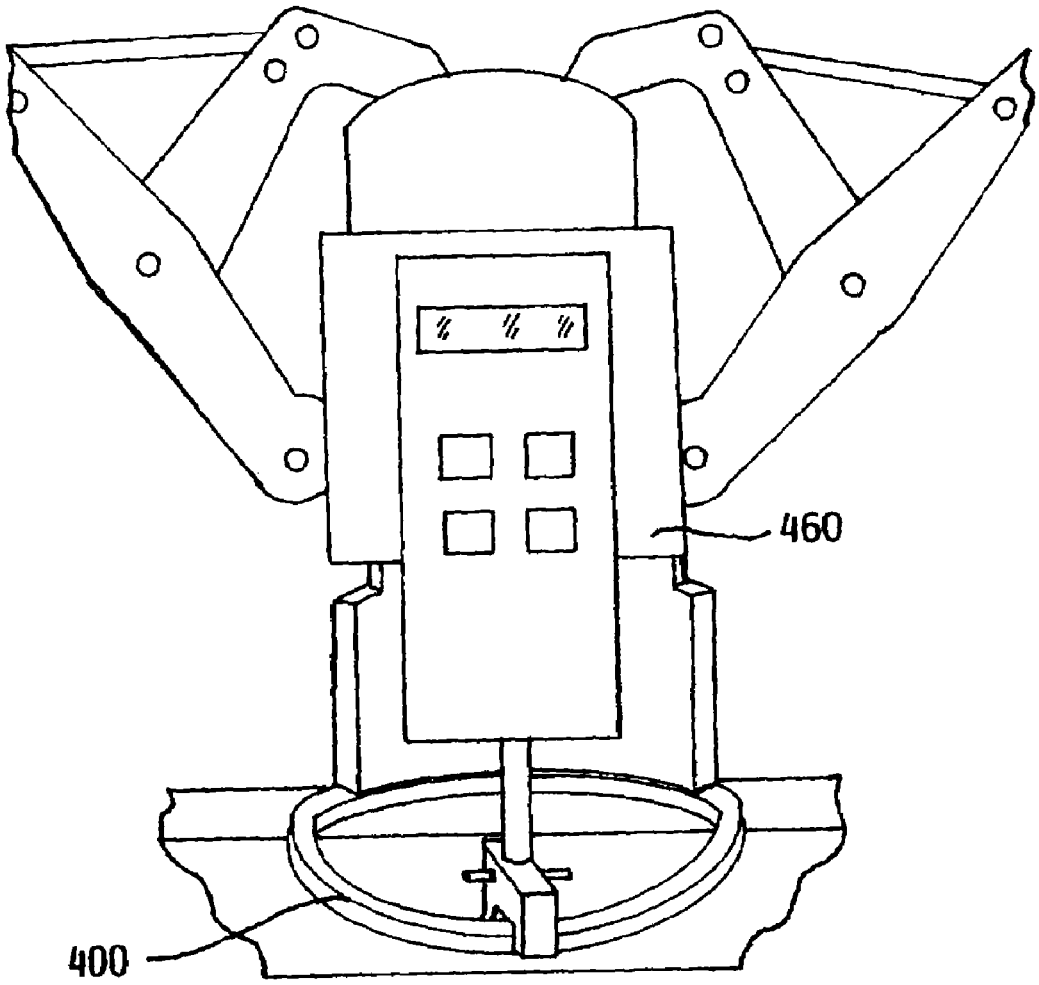
FIG. 19 is a perspective view of a CMP retaining ring according to an embodiment of the present invention in a flexure testing apparatus.
Figure 20:
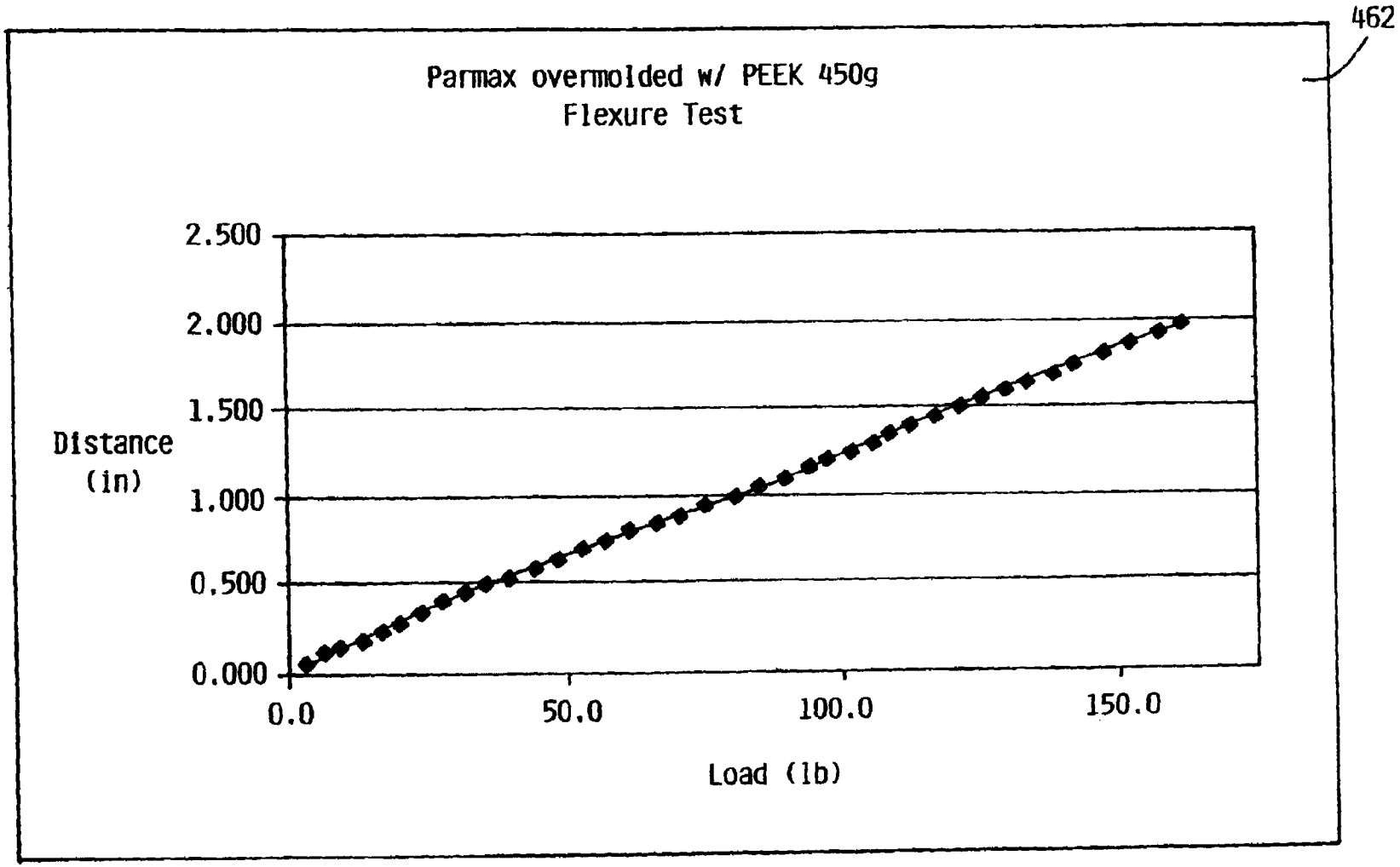
FIG. 20 is a graph displaying flexure testing results of a CMP retaining ring according to an embodiment of the present invention.
Figure 21:
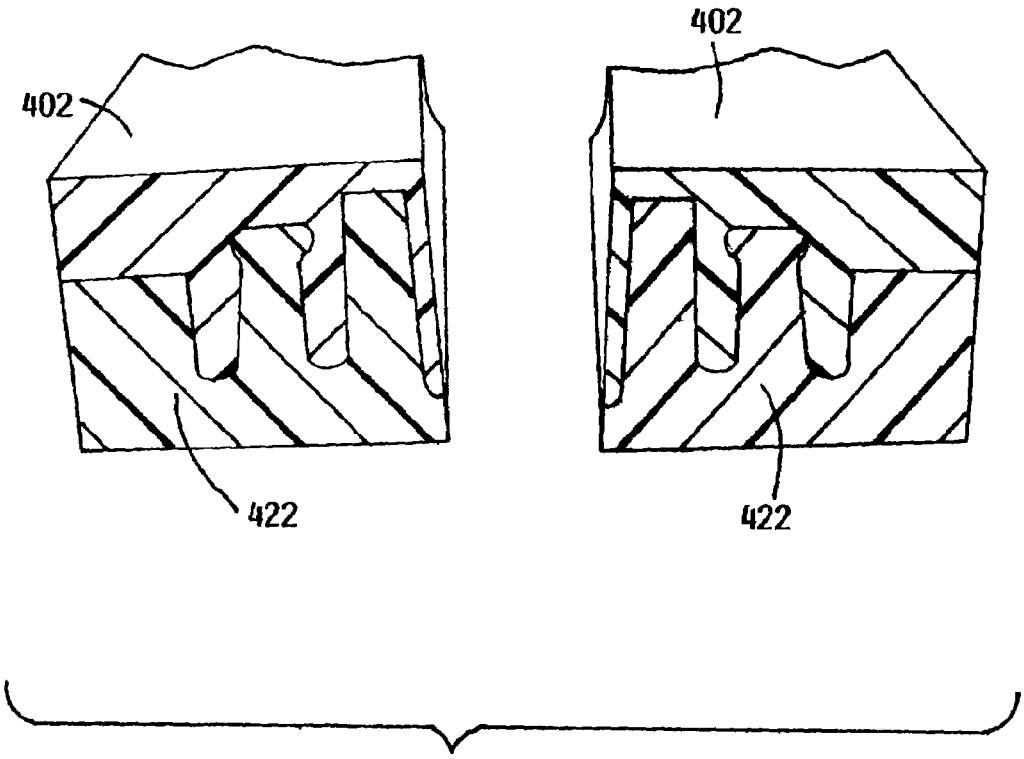
FIG. 21 is a perspective view of a portion of a fractured CMP retaining ring according to an embodiment of the present invention.

Testing has proven that the above embodiments provide a rigid structure. As shown in FIGS. 19-21, a retaining ring 400 according to an embodiment of the present invention was flexure tested with a flexure testing apparatus 460. Retaining ring 400 was made from a molded Parmax (Mississippi Polymer Technology) backbone portion 422 and overmolded with 450 g of PEEK base portion 402. Flexure testing continued until the ring 400 fractured. Testing results 462 are shown in FIG. 20. The results illustrate that a lightweight retaining ring 400 with ribs and channels that are overmolded provides a rigid structure. Even when fractured, as shown in FIG. 21, the base portion 402 and backbone portion 422 remain cohesive along their bonding surfaces.

Further testing has demonstrated the substantial pull-out strength of the backbone portion of embodiments of the present invention. Mounting of the retaining ring to the CMP platen rotating head was facilitated by multiple threaded bolts. The ceramic filled PEEK allows multiple tapped threaded holes to be produced around the perimeter to secure the retaining ring to the head. Test samples used stainless steel socket head cap screw—#8-32 that were threaded in 3 full turns into tapped #8-32 threads. The retaining ring backbone portion used a ceramic filled PEEK. The results 500 from the test are shown in the Table in FIG. 22.

Figure 23:
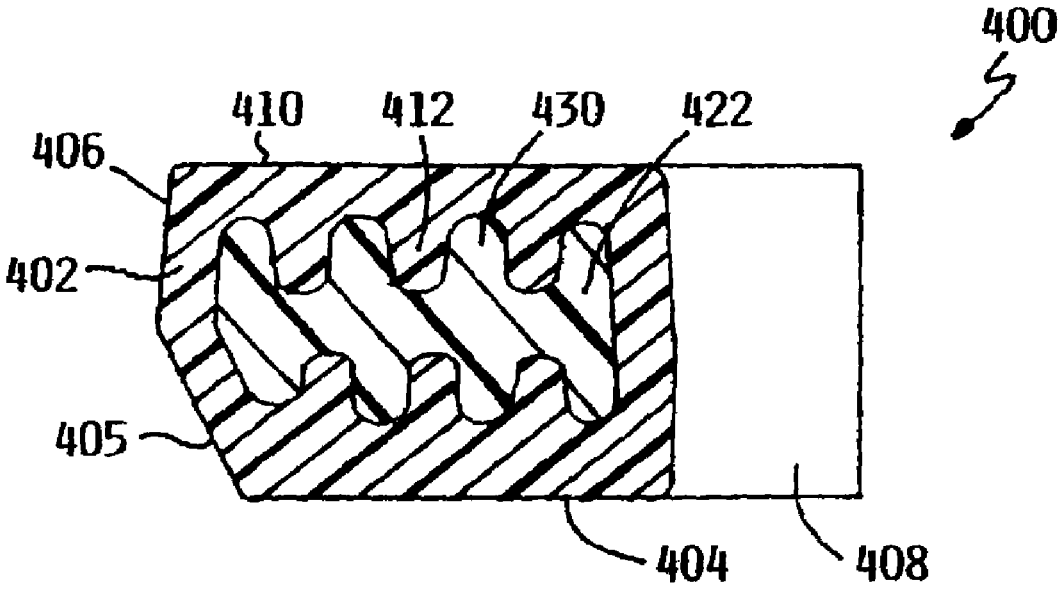
FIG. 23 is a cross sectional view of a CMP retaining ring according to an embodiment of the present invention.
Figure 24:
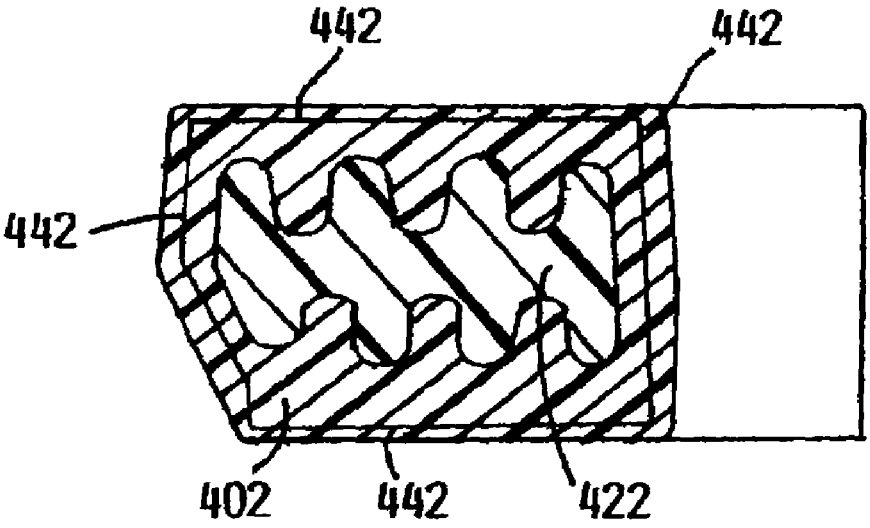
FIG. 24 is a cross sectional view of a CMP retaining ring according to an embodiment of the present invention.

Referring now to FIGS. 23 and 24, a cross-section of a further embodiment of the present invention is depicted. CMP retaining ring 400 comprises a base portion 402 and a backbone portion 422. Base portion 402 is generally defined by a flat bottom surface 404, an outer surface 406, an inner surface 408, and an upper surface 410. Base portion 402 can include a beveled edge, for example beveled outside edge 405. Base portion may also include one or more annular ribs 412. Backbone portion 422 may include one or more annular ribs 430 adapted to mate with ribs 412 on base portion 402. In the present embodiment, backbone portion 422 is molded first, and base portion 402 is overmolded onto backbone portion 422, such that backbone portion 422 is fully encapsulated within base portion 402. Ribs 412 and ribs 430 provide additional bonding surfaces for base portion 402 and backbone portion 422, increasing the bond strength between base portion 402 and backbone portion 422.

Base portion 402 can be injection molded from a plastic, preferably polyetheretherketone (PEEK) or blends with other polymers that include PEEK or that may include other wear resistant plastic materials and blends. PEEK is advantageous in that it can support the wafer with little risk of chipping or cracking the substrate edge, while still providing high wear and abrasion resistance. Base portion 402 can also be comprised of PEEK that is extruded or compression molded and then machined. One of skill in the art will recognize that different polymers can be used to increase or decrease the wear resistance of base portion 402.

Backbone portion 422 can be comprised of a ceramic material or other filler/additive. For example, the ceramic material may be dispersed in a polymer like PEEK (an example of this is STAT-PRO®, a conductive ceramic PEEK from Entegris Inc.). The ceramic material can then be used to tailor the structural rigidity, shear resistance, thermal conductance, or other property of backbone portion 422. Backbone portion 122 structurally enhances the stiffness of CMP ring 400 based on its modulus, wherein backbone portion 422 may have a flexural modular range that includes, but is not limited to, 600,000 to 1,400,000 psi. The rigidity that a ceramic material provides will help provide solid equipment attachment and will reduce damage to the ring from the shearing, rotational, and other forces imparted by a carrier head to CMP ring 400.

FIG. 24 depicts molded base portion flashing 440 on CMP ring 400. Base portion flashing 440 may be present on base portion 402 after the molding operation. One or more surfaces of ring 400 may be finished by a post-molding machining process to remove all or a portion of the flashing. Post-molding machining can remove the flashing to a final surface and finish illustrated by the solid line 442. Following machining, surfaces that do not contact the polishing pad can be further optionally finished with about 600 grit or finer polishing paper. For surfaces that contact the pad or substrate, polishing paper of about 1500 grit or finer can be used. For less critical substrates or pads, lower grit polishing or as machined surfaces can be used.

Figures 25, 26, 27:
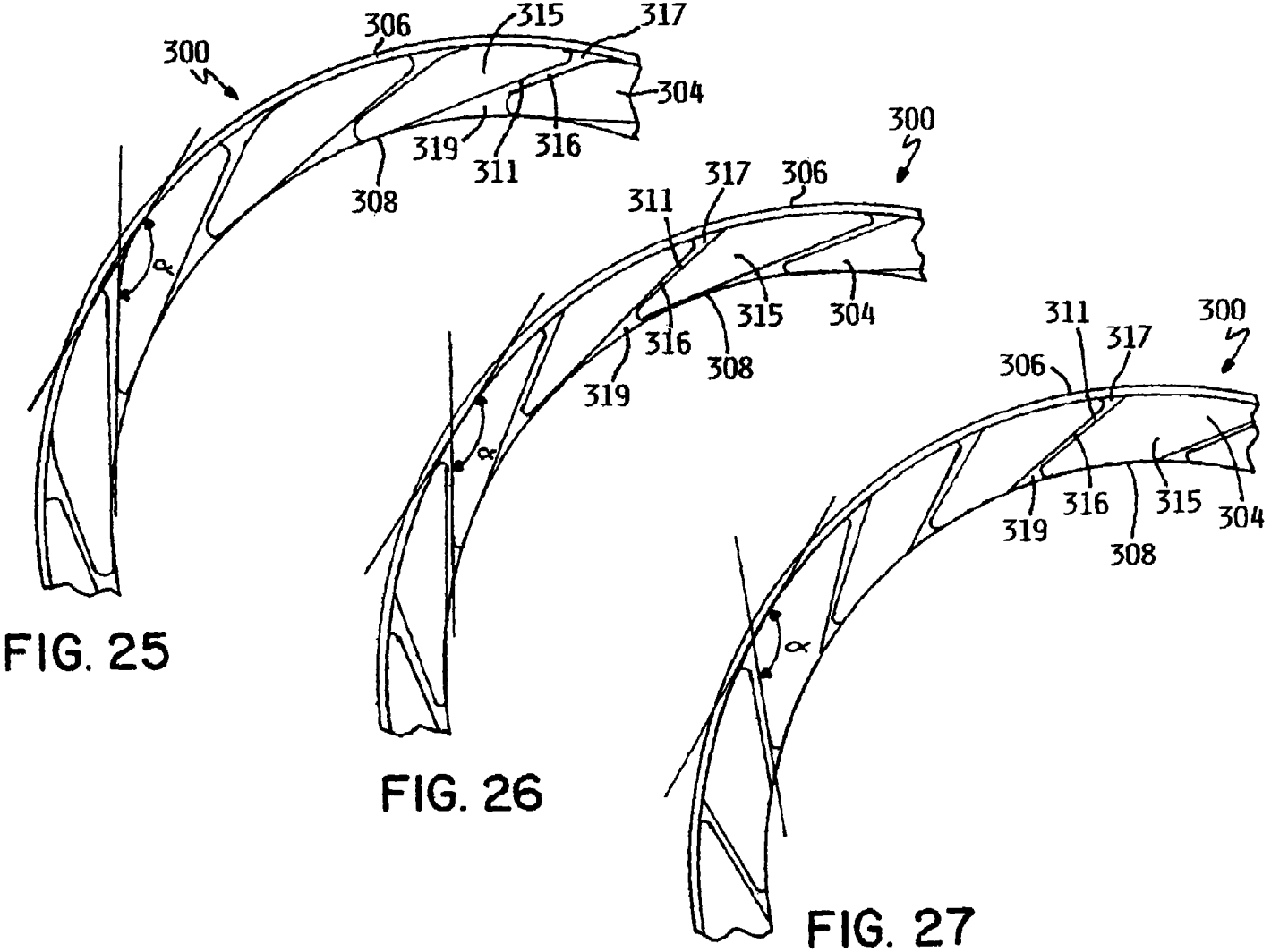
FIG. 25 is a perspective view of a portion of the bottom of a CMP retaining ring according to an embodiment of the present invention.
FIG. 26 is a perspective view of a portion of the bottom of a CMP retaining ring according to an embodiment of the present invention.
FIG. 27 is a perspective view of a portion of the bottom of a CMP retaining ring according to an embodiment of the present invention.

FIGS. 25-27 depict further embodiments of the structure of retaining ring pads or foils 315 and channels or grooves 316. Channels 316 may be straight, curved, or arcuate. CMP ring 300 includes a pad contacting surface 304, made up of a plurality of foils 315. In a preferred embodiment, the pad contacting surface 304 is between 75% and 95% of the total area of ring 300. In a further embodiment, the pad contacting surface 304 is less than 92% of the total area of ring 300. In an alternate embodiment, the pad contacting surface 304 is less than 90% of the total area of ring 300. In a further alternate embodiment, the pad contacting surface 304 is less than 88% of the total area of ring 300.

Channels 316 provide for slurry flow, and each channel 316 includes an inlet portion 319, an outlet portion 317, and a neck portion 311. By varying the shape of foils 315, the shape of channels 316, the shape of inlet 319 and outlet 317, or any combination thereof, the slurry transfer characteristics can be adjusted, thereby adjusting the polishing process. Numerous parameters of channel 316 can be modified, such as the angle $\alpha$, the width, the depth, the radii where channel 316 meets outer surface 306 and inner surface 308, as well as the overall number of channels 316 on ring 300. FIG. 26 depicts a CMP ring 300 having a channel 316 with larger radii in the area where channel 316 meets outer surface 306 and inner surface 308, as compared to the radii of channel 316 depicted in FIG. 25. Angle $\alpha$ of channel 316 in FIGS. 25 and 26 is 150 degrees.

FIG. 27 depicts a CMP ring 300 having a greater contact surface 304 as compared to CMP ring 300 in FIGS. 25 and 26, while maintaining the same ring dimensions. The radii where channel 316 meets outer surface 306 and inner surface 308 have been decreased as compared to FIG. 25 to increase the area of contact surface 304. The angle $\alpha$ of channel 316 is 144 degrees, however, the numerical values of angle $\alpha$ presented herein are for illustrative purposes only and should not be considered limiting.

Angle $\alpha$ is measured relative to a line drawn tangent across outer surface 306 at the point where channel 316 would intersect with outer surface 306 if channel 316 did not include outlet portion 317, as illustrated in FIGS. 25-27. The angle of the channel can be taken with respect to a first reference at a side wall of the channel where the side walls are parallel in the central portion of the ring or said reference can be at the mid line of the channel in the central portion of the ring (intermediate the outer periphery and the inner periphery) where the sidewalls of the channel are not parallel. For reference, angle $\alpha$ is for counterclockwise rotation of ring 300 when pad surface 304 is facing downward into a polishing pad. In a preferred embodiment, angle $\alpha$ is at least 130 degrees.

Figure 30A:
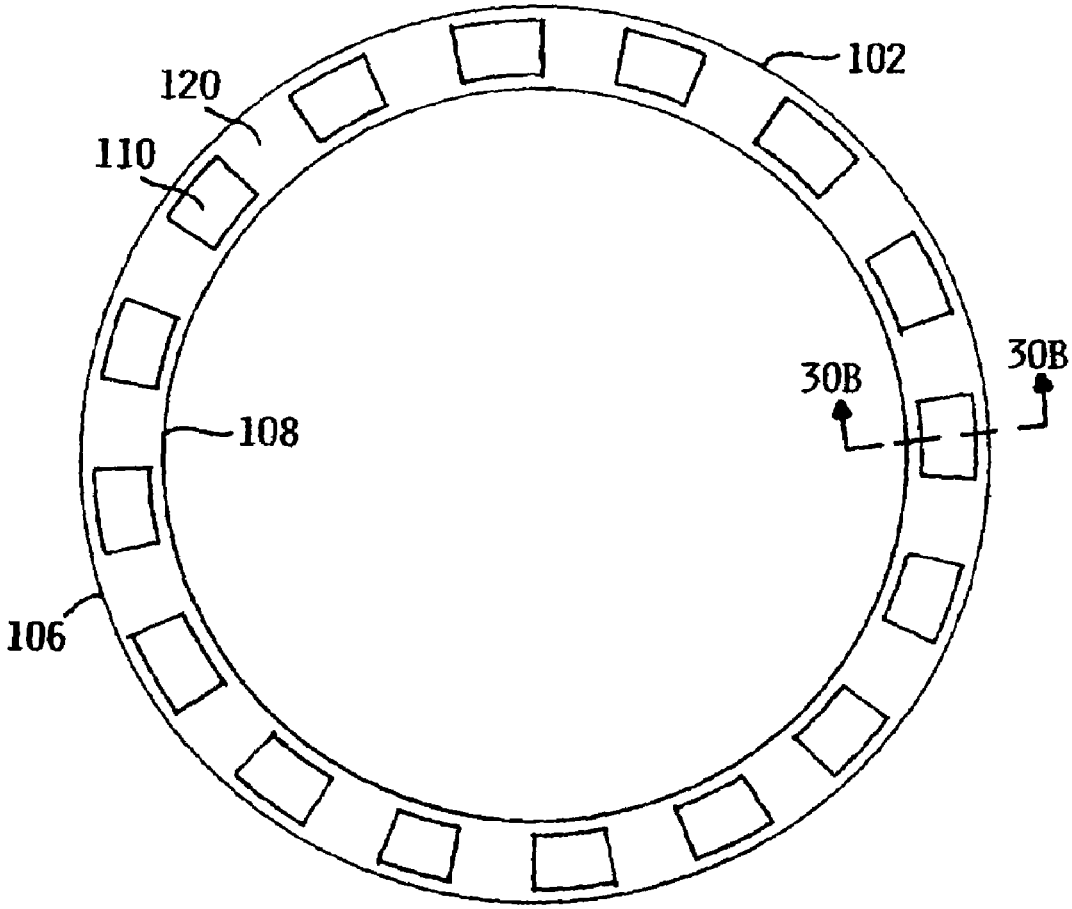
FIG. 30A is an overhead view of one embodiment of the base portion of a CMP retaining ring according to an embodiment of the present invention.
Figure 30B:
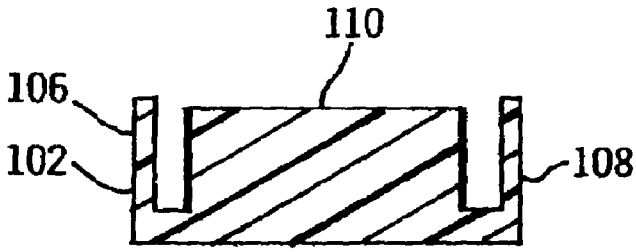
FIG. 30B is a cross section view of the base portion of a CMP retaining ring taken along line 30B-30B in FIG. 30A.
Figure 31:
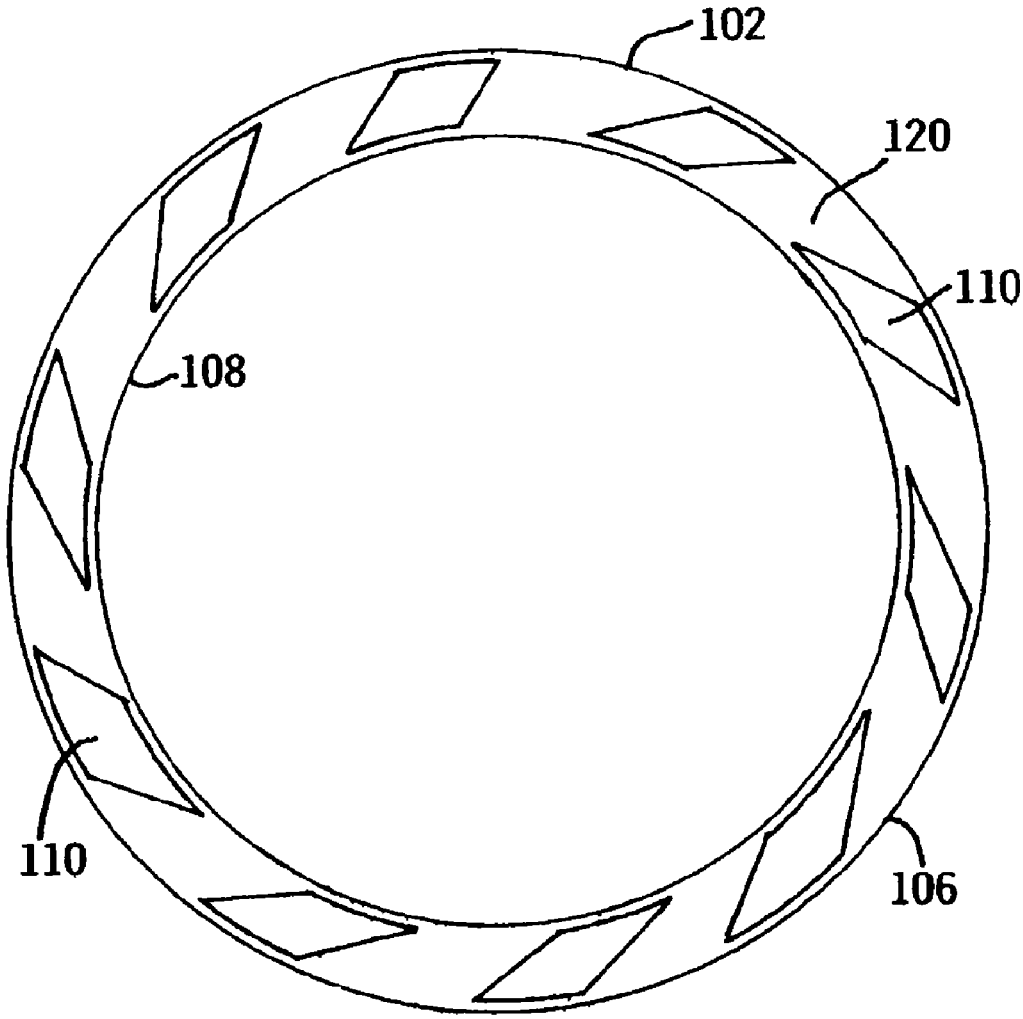
FIG. 31 is an overhead view of one embodiment of the base portion of a CMP retaining ring according to an embodiment of the present invention.

The shape of the ribs and rib channels of the various embodiments of the present invention may be varied to modify the bonding between a base and a backbone. For example, the ribs and rib channels may be annular and concentric with the retaining ring profile when viewed from above, as depicted in FIGS. 2, 4-6, 8B, 8C, and 9A. The ribs and rib channels may be continuous around the ring, or may be non-continuous, such as depicted in FIGS. 9A, 9B, 30A, 31, and 32. The ribs and rib channels may also be non-concentric with the ring profile, having for example a spiral shape when viewed from overhead. Further, the ribs may be non-concentric such that they extend generally from one inner edge of the ring to the other, for example the ribs may be orthogonal to an edge, or meet an edge of the ring at an angle. The non-concentric ribs may fully extend from one edge of the ring to the other, or they may extend only partially between edges of the ring, as depicted in FIG. 30B.

Figure 29:
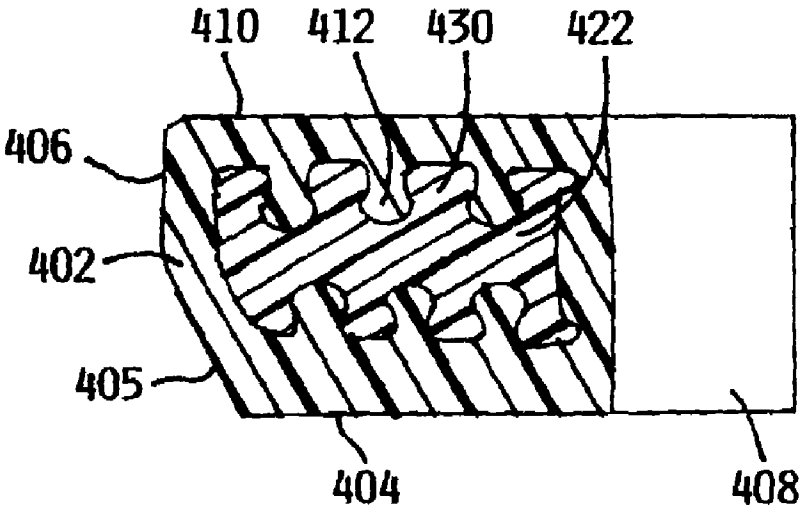
FIG. 29 is a cross sectional view of a CMP retaining ring according to an embodiment of the present invention.
Figure 28:
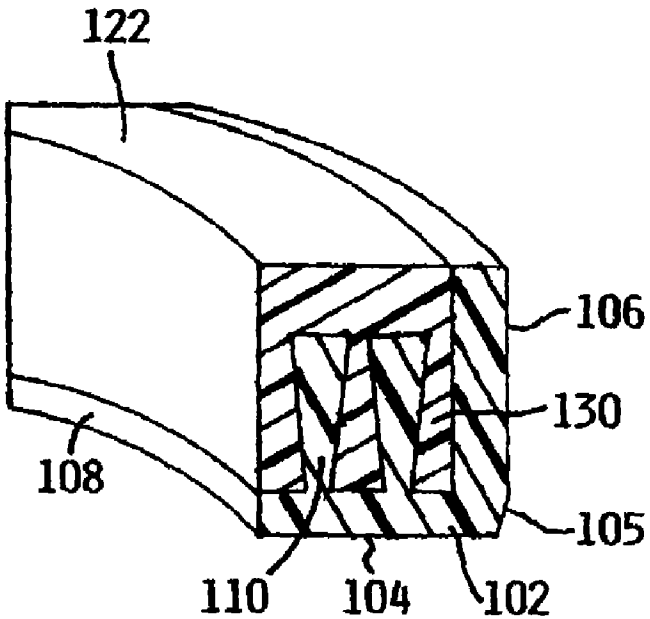
FIG. 28 is a cross sectional view of a CMP retaining ring according to an embodiment of the present invention.

Additionally, the ribs may have a flared or tapered cross-section to create mechanical coupling between the base and the backbone, as depicted in FIGS. 28 and 29. For example, if a backbone is first molded having one or more ribs with a flared cross-sectional profile, when a base portion is overmolded onto the backbone, the base will be interlocked with the backbone after the molding process. Similarly, a base portion can be first molded having one or more ribs with a flared cross-sectional profile, such that when a backbone is overmolded onto the base portion, the backbone and the base are interlocked.

Figure 32:
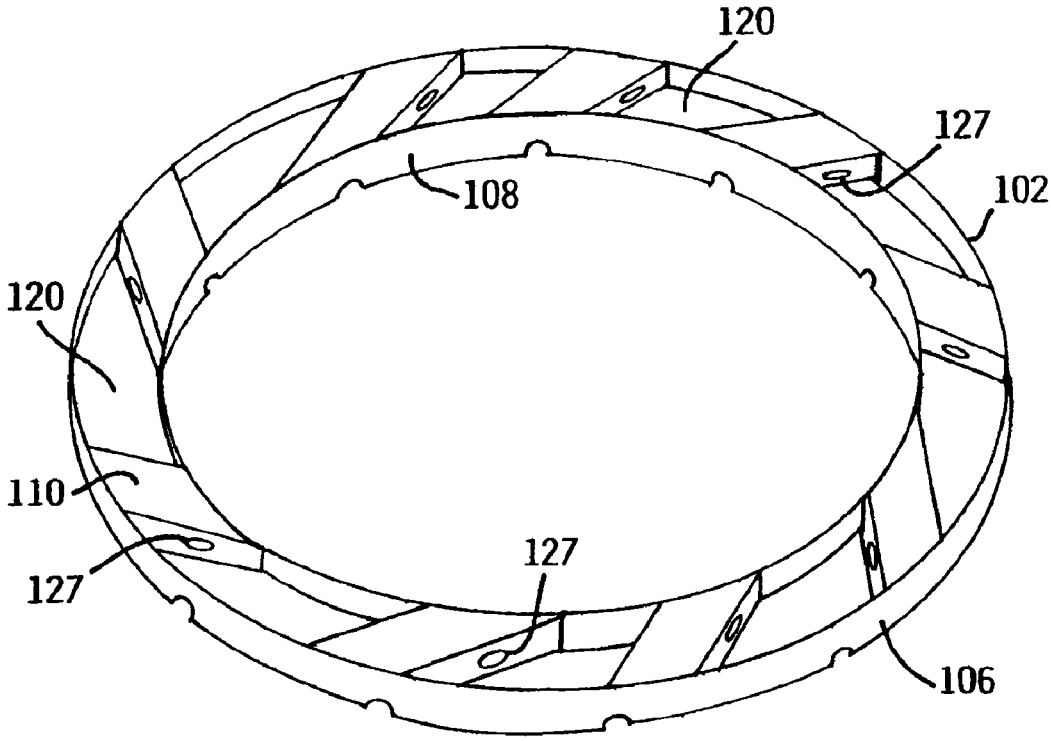
FIG. 32 is a perspective view of the embodiment depicted in FIG. 31.

Further, ribs may be provided with transverse passageways to create mechanical interlocking between the base and the backbone, as depicted in FIG. 32. For example, if a base portion 102 is first molded having one or more ribs 110 including one or more transverse passageways 127, when a backbone is overmolded onto base 102, the material flows into passageways 127, creating a mechanical bond between the backbone and base 102. Similarly, a backbone can be first molded having one or more ribs including one or more transverse passageways. When a base portion is overmolded onto the backbone, the material fills in the passageways, thus creating a mechanical bond between the base and backbone. In the case of multiple ribs, the transverse passageways provide a link between neighboring rib channels.

The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. A retaining ring for use in a chemical mechanical polishing operation, comprising:

an annular backbone portion having one or more circumferential and axially projecting backbone portion ribs with one or more channels defined by the one or more ribs, the ribs having an axial length substantially greater than a corresponding width and the backbone portion comprising a rigid polymer material; and a wear-resistant polymer base portion having a flat bottom surface, one or more circumferential and axially projecting base portion ribs with one or more channels defined by the one or more ribs, the ribs having an axial length substantially greater than a corresponding width and a plurality of grooves in the bottom surface extending between an inner edge and an outer edge of the retaining ring, the grooves adapted to facilitate transfer of slurry during the polishing operation, wherein the backbone portion and the base portion are bonded together by an overmolding process such that the backbone portion ribs mate to the base portion channels and the base portion ribs mate to the backbone portion channels such that they are directly interlacing and completely conforming with each other, and wherein the backbone portion ribs and the base portion ribs extend a substantial portion of an axial thickness of the bonded backbone portion and base portion.

2. The retaining ring of claim 1, wherein the plurality of grooves each include at least one divergent opening.

3. The retaining ring of claim 1, wherein the base portion encapsulates the backbone portion.

4. The retaining ring of claim 1, wherein the base portion comprises polyetheretherketone and the backbone portion comprises polyetheretherketone blended with ceramic.

5. The retaining ring of claim 1, further comprising mounting fixtures for securing the retaining ring to a polishing unit.

6. The retaining ring of claim 1, wherein the angle of the grooves relative to a line tangent to the outer edge is at least 135 degrees.

7. The retaining ring of claim 1, wherein the grooves define a plurality of pad contacting areas, the pad contact areas comprising less than 92% of the area of the bottom surface.

8. The retaining ring of claim 1, wherein the backbone portion ribs have a non-constant axial height such that they define voids along the ribs.

9. The retaining ring of claim 8, wherein the voids are filled with overmolded base portion material.

10. The retaining ring of claim 1, wherein the base portion ribs have a non-constant axial height such that they define voids along the ribs.

11. The retaining ring of claim 10, wherein the voids are filled with overmolded backbone portion material.

12. A retaining ring for use in a chemical mechanical polishing operation, comprising:

an annular backbone portion having two or more backbone ribs with channels defined by the backbone ribs, the ribs having an axial length substantially greater than a corresponding width, and the backbone portion comprising a rigid polymer material; and a wear-resistant polymer base portion having a flat bottom surface, two or more base ribs with channels defined by the base ribs, the ribs having an axial length substantially greater than a corresponding width, and a plurality of grooves in the bottom surface extending between an inner edge and an outer edge of the retaining ring, the grooves adapted to facilitate transfer of slurry during the polishing operation, wherein the backbone portion and the base portion are bonded together by an overmolding process such that the backbone portion ribs mate to the base portion channels, and the base portion ribs mate to the backbone portion channels such that they are directly interlacing and completely conforming with each other, and wherein the backbone portion ribs and the base portion ribs extend a substantial portion of an axial thickness of the bonded backbone portion and base portion.

13. The retaining ring of claim 12, wherein the backbone ribs include passageways for material flow during an overmolding process.

14. The retaining ring of claim 13, wherein the base portion ribs include passageways for material flow during an overmolding process.

15. The retaining ring of claim 13, wherein the backbone ribs and the base portion ribs are tapered to create a mechanical coupling between the backbone and the base portion.

16. The retaining ring of claim 12, wherein the backbone portion ribs have a non-constant axial height such that they define voids circumferentially along the ribs.

17. The retaining ring of claim 16, wherein the voids are filled with overmolded base portion material.

18. The retaining ring of claim 12, wherein the base portion ribs have a non-constant axial height such that they define voids circumferentially along the ribs.

19. The retaining ring of claim 18, wherein the voids are filled with overmolded backbone portion material.

20. A retaining ring for use in a chemical mechanical polishing operation, comprising:

an annular backbone portion having one or more circumferential and axially projecting backbone portion ribs with one or more channels defined by the one or more ribs, the ribs having an axial height that is at least partially substantially greater than a corresponding width and the backbone portion comprising a rigid polymer material; and a wear-resistant polymer base portion having a flat bottom surface, one or more circumferential and axially projecting base portion ribs with one or more channels defined by the one or more ribs, the ribs having an axial height that is at least partially substantially greater than a corresponding width., and a plurality of grooves in the bottom surface extending between an inner edge and an outer edge of the retaining ring, the grooves adapted to facilitate transfer of slurry during the polishing operation, wherein the axial height of at least one of the backbone portion ribs and base portion ribs is a non-constant axial height so as to define voids circumferentially along the at least one rib, wherein the backbone portion and the base portion are bonded together by an overmolding process such that the backbone portion ribs mate and completely conform to the base portion channels, the base portion ribs mate and completely conform to the backbone portion channels, and at least one of the backbone portion and the base portion mates with and completely conforms to the voids on the opposite portion.

* * * * *